US008602263B2

(12) United States Patent
Baron et al.

(10) Patent No.: US 8,602,263 B2
(45) Date of Patent: Dec. 10, 2013

(54) COUPLING FOR PUMP AND CONTAINER

(75) Inventors: Richard D. Baron, Zephyrhills, FL (US); Sean H. Frielich, Auburndale, FL (US)

(73) Assignee: Nestec S.A., Vevey (CH)

( * ) Notice: Subject to any disclaimer, the term of this patent is extended or adjusted under 35 U.S.C. 154(b) by 748 days.

(21) Appl. No.: 12/655,863

(22) Filed: Jan. 8, 2010

(65) Prior Publication Data

US 2010/0176155 A1 Jul. 15, 2010

Related U.S. Application Data

(60) Provisional application No. 61/204,721, filed on Jan. 9, 2009.

(51) Int. Cl.
*B67D 7/58* (2010.01)

(52) U.S. Cl.
USPC ..... 222/153.13; 222/82; 222/83.5; 222/133; 222/129.1; 222/153.07; 222/325; 222/145.5; 222/207

(58) Field of Classification Search
USPC ..... 222/81–83.5, 129.1–129.4, 133, 145.1, 222/145.4, 145.5, 207, 212, 214, 325, 222/153.05–153.07, 153.13, 541.2, 541.6, 222/541.9
See application file for complete search history.

(56) References Cited

U.S. PATENT DOCUMENTS 4,030,494 A 6/1977 Tenczar
4,137,930 A 2/1979 Scholle
4,296,786 A 10/1981 Brignola
4,722,449 A * 2/1988 Dubach ..... 215/235
4,757,916 A 7/1988 Goncalves
4,867,326 A 9/1989 O'Meara
5,102,010 A 4/1992 Osgar et al.
5,114,047 A 5/1992 Baron et al.
5,348,192 A * 9/1994 Sardynski et al. ..... 222/129.1
5,419,445 A 5/1995 Kaesemeyer
5,474,209 A 12/1995 Vallet Mas et al.
5,482,176 A 1/1996 Maietta et al.
5,503,302 A * 4/1996 DeJonge ..... 222/82
5,518,147 A * 5/1996 Peterson et al. ..... 222/153.07
5,782,345 A 7/1998 Guasch et al.
5,927,549 A 7/1999 Wood
6,419,101 B1 7/2002 Hessel et al.
6,446,839 B1 9/2002 Ritsche
6,447,743 B1 9/2002 Devic et al.
6,644,519 B2 11/2003 Last
6,722,530 B1 4/2004 King et al.
6,758,372 B2 7/2004 Studer et al.
6,997,351 B2 2/2006 Cho
7,337,921 B2 3/2008 Ma
7,651,015 B2 * 1/2010 Girard et al. ..... 222/509

* cited by examiner

*Primary Examiner* — J. Casimer Jacyna
(74) *Attorney, Agent, or Firm* — Frijouf, Rust & Pyle P.A.

(57) ABSTRACT

An improved coupling is disclosed for connecting a pump to a container. A first embodiment of the improved coupling incorporates a slidable coupling sleeve for piercing a frangible seal for providing liquid communication from the container to the pump. A first embodiment of the improved coupling incorporates coupling for providing liquid communication from the container to the pump. The invention is suitable for use with an aseptic container, a refrigerated container or a non-refrigerated container with or without preservatives.

21 Claims, 18 Drawing Sheets

PRIOR ART

PRIOR ART

PRIOR ART

COUPLING FOR PUMP AND CONTAINER

CROSS-REFERENCE TO RELATED APPLICATIONS

This application claims benefit of U.S. Patent Provisional application Ser. No. 61/204,721 filed Jan. 9, 2008. All subject matter set forth in provisional application Ser. No. 61/204,721 filed Jan. 9, 2008 is hereby incorporated by reference into the present application as if fully set forth herein.

BACKGROUND OF THE INVENTION

1. Field of the Invention

The invention relates to liquid flow from a terminal orifice and more particularly to an improved coupling for connecting a pump to a container for providing liquid flow from a terminal orifice.

2. Background of the Related Art

Various types of liquid dispensing devices have been provided by the prior art for mixing a first liquid and a second liquid. One particular type of liquid dispensing device relates to the mixing of a concentrate with a diluent. In this type of liquid dispensing device, a liquid concentrate is mixed with a larger volume of liquid diluent for producing a final liquid mixture. Liquid dispensing devices for mixing a liquid concentrate with a liquid diluent have found widespread use for a number of applications including the mixing and dispensing a consumable liquid. When a liquid dispensing device was used for dispensing consumable liquid, the liquid dispensing device must be constructed in a manner to be periodically cleaned in order to maintain the wholesomeness of the consumable liquid.

A significant advancement in the art of dispensing of consumable liquids from a concentrate is the invention set forth in our U.S. Pat. No. 5,114,047. U.S. Pat. No. 5,114,047 discloses a pump and mixing device for pumping a liquid from a container and mixing with a diluent. The pump and mixing device comprises a body member having an input body portion and an output body portion with a flexible wall defining a pumping chamber between the input body portion and the output body portion. The input body portion has an input aperture for enabling the liquid to flow from the container into the input body portion. The output body portion has an output aperture communicating with the flowing diluent. An input one-way valve is disposed in the input aperture for permitting the flow of liquid only from the container to the pumping chamber. An output one-way valve is disposed in the output aperture for permitting the flow of liquid only from the pumping chamber. A motive device reciprocates the output body portion relative to the input body portion between a first and a second position for causing liquid to flow from the container through the input one-way valve into the pumping chamber when the output body portion is moved into the first position. A motive device reciprocates the output body portion relative to the input body portion for causing liquid to flow from the pumping chamber through the output one-way valve to mix with the diluent when the output body portion is moved into the second position.

U.S. Pat. No. 5,114,047 was reduced to practice in a beverage vending machine for pumping a liquid concentrate from a container and mixing the concentrate with a diluent. The beverage vending machine mixed various liquid concentrates with a water diluent to provide a consumable liquid. The aforesaid beverage vending machine had the advantage of utilizing a disposable pump and mixing device connected to a container storing the liquid concentrate. After the depletion of the liquid concentrate, the pump and mixing device as well as the container was discarded thus eliminating the need for periodic cleaning. The beverage vending machine manufactured under U.S. Pat. No. 5,114,047 found rapid substantial commercial success.

U.S. Design Pat. D340,866 and U.S. Design Pat. D355,854 and U.S. Design Pat. D467,806 illustrate examples of disposable containers suitable for use with the a pump and mixing device set forth in U.S. Pat. No. 5,114,047.

U.S. Pat. No. 3,172,568 to Modderno discloses a compartmental, pressurized dispensing device for keeping two or more materials separated from each other until time of use. More particularly, this invention relates to a pressurized container for dispensing a composition produced when diaphragms separating the container into compartments are ruptured so that the ingredients from the compartments can be thoroughly mixed and dispelled by pressure within the container.

U.S. Pat. No. 4,137,930 to Scholle discloses a normally closed valve characterized by an integral valve body forming a fluid passage between an inlet thereto and an outlet therefrom, and a flow barrier within the passage integrally joined with the body to hermetically seal the passage. The barrier is movable or rupturable by a fluid coupler, inserted into the outlet end of the passage, to open the passage between the inlet thereto and the coupler. Preferably, the valve is economically formed of a plastic material, such as polyethylene, and connects at its outlet with a fluid coupler having a normally closed, movable seal at its inlet. In the use of the valve, upon movement of the inlet end of the coupler into the outlet end of the passage, the valve passage forms a fluid seal therewith prior to engagement of the barrier thereby. Continued movement of the coupler into the valve then moves the flow barrier to open the passage, and engages the coupler seal with a plunger to move the seal from a seat at the inlet to the coupler to establish the fluid passage between the inlet to the valve passage and the inlet to the coupler. In consequence of forming a seal between the valve and coupler prior to opening of either the flow barrier or the coupler seal, a connection may be established between the coupler and the valve in a drip-free manner, and the fluid to be valved is at all times maintained out of contact with the atmosphere and in a sanitary condition.

U.S. Pat. No. 4,296,786 to Brignola discloses a transfer device for use in mixing substances in different containers normally closed by a stopper of resilient material having a puncturable diaphragm consisting of a central body portion and a pair of aligned spikes or cannulas projecting from opposite sides of the central body portion. Each of the cannulas terminates in a tip portion remote from the central body portion and there are at least one pair of transfer passages extending through the cannulas, the opening at one tip portion of one of the transfer passages is of smaller cross section than the opening of the transfer passage at the tip of the other cannula. The other transfer passage is the reverse of the first transfer passage; that is, the cross sectional relationships of the openings at the tips are the opposite of the first transfer passage. Thus in use the cannulas are inserted through the stopper in a pair of containers to transfer contents, usually fluid, from one container to the other, and the specific arrangement of the transfer passages facilitates smooth flow through the transfer device, one being a fluid passage, the other an air venting passage. The invention also includes the combination of a transfer device, an outer cover member including means for supporting the transfer device therein and a detachable closure member overlying and normally sealing the opening in the outer cover member.

U.S. Pat. No. 4,722,449 to Dubach discloses a container closure attachable directly or indirectly to a container neck sealed by means of a pierceable film seal. The provision of a film seal covering the container neck guarantees the user that the contents of the container are authentic and original as supplied by the manufacturer. The film seal is pierced as the closure is adjusted from an intact to an access position on the container neck. In the upper intact position, a safety band remains intact. The closure can be adjusted to the lower access position only after the safety band has been removed, and the film seal is pierced as the closure is adjusted to the lower access position. Hatchet-like serrations may be provided on the inner side of the safety band engaging the container, thus making it impossible to unscrew a screw-type closure without removing the safety band. The safety band may be provided on a separate intermediate piece that may be snap-fitted or screwed onto the container neck. Opening means for piercing the film seal may be provided on the intermediate piece.

U.S. Pat. No. 4,757,916 to Goncalves discloses a device that delimits two compartments which are intended to contain each one product and which are separated by a separating element constituted by at least one cover perforatable as a result of the manipulation of a mixing perforator. This perforator is placed into one of the compartments, so that its cutting end comes to be near the above-mentioned separating element in the storage position, and that its other end is situated opposite a deformable obturating partition of the compartment. An element for manipulating the perforator is disposed in the extension of this latter, on the other side of the partition; it is displaceable for translation to pass from the storage position to a mixing position wherein it is acting on the perforator through the partition to cause it to cut the separating element. Can be used for storing a hair dye.

U.S. Pat. No. 4,867,326 to O'Meara discloses a child resistant cap and tube assembly with a tube for containing a product and having an end portion terminating in an axially centered open surface at its outer perimeter and having a recessed thin wall below the surface to seal the tube. The tube has a second surface of interference to axial movement on the end which is a predetermined distance from the perimeter. A cap is also provided, having a central axis for alignment with the tube and sized to slidably engage the end portion. The cap also has a resistance surface for engaging the surface of interference at a predetermined distance to locate the cap on the end portion at a first position to protect the recessed thin wall. The cap has an axially centered puncture means positioned inside the cap to puncture the recessed thin wall upon movement of the cap to a second position for opening the tube. Finally, the surface of interference and the resistance surface are positioned to cooperatively resist movement of the cap to the second position with a force sufficient to prevent inadvertent movement to that second position.

U.S. Pat. No. 5,102,010 to Osgar, et al. discloses a container for storage, transport and dispensing of liquid chemicals using a collapsible thin film pouch that is sealed to a fitment and is positioned within a bottle or overpack. A retainer and cap hold the pouch and fitment in place within the bottle. The cap provides an inner seal and an outer seal that remain intact during shipping and storage. In use, the outer seal is removed and the container is connected to either a manual or an automated dispensing system that includes a valve probe that breaks the inner seal. In the manual system the bottle is inverted so that flow of liquid from the pouch is gravity assisted. In the automated system, the container is placed within a pressure vessel and air pressure is applied both to the outside of the bottle and also to the inside of the bottle to assist in collapsing the pouch and forcing the liquid out of the pouch. When empty, the container is removed from the manual or automated dispensing system and the cap and retainer are removed to allow removal and disposal of the pouch and fitment.

U.S. Pat. No. 5,474,209 to Vallet Mas, et al discloses a pharmaceutical product container housing two separate substances. The container includes a bottom container having a first substance. The bottom container has an edge disposed at an open mouth thereof. A top container has a second substance. The top container has a frangible bottom wall. The top container has a flap extending radially outwardly. The flap includes an annular rib. The annular rib has a device for retaining the edge of the bottom container. The top container has a neck portion extending axially remote from the bottom wall. The neck has a helical thread to receive the cap. The neck includes a plurality of radially extending toothed projections about its perimeter. A tubular sleeve is disposed within the top container. The tubular sleeve is axially moveable with respect to the top container. The tubular sleeve has a first end and a second end. The first end has a device for partially cutting the bottom wall of the top container upon rotation of the cap onto the neck to create axial movement of the tubular sleeve in a first direction. The second end terminates with a radially protruding wing and a truncated-cone shaped portion. The truncated-cone shaped portion has a device for functioning as a medicinal dropper. A seal is connected to the cap with a perforated connection. The seal includes a plurality of radially extending toothed projections about its perimeter that mate with the plurality of projections in the neck such that upon rotation of the cap off of the neck, the perforated connection breaks and the seal can be removed. The cap can then be rotated onto the neck to effect the cutting of the bottom wall.

U.S. Pat. No. 5,482,176 to Maietta, et al. discloses a closure assembly for piercing a diaphragm over a discharge opening in a container. The invention comprises a cap of cup-like form having internal thread means and a generally tubular spout member mounted on the container surrounding the diaphragm. A piercing fitment disposed interiorly of the spout member has a series of depending teeth arranged in a circular array. An interengaging means cooperates between the spout member and piercing fitment and cap whereby rotational movement of the cap in one direction effects downward displacement of the piercing fitment to pierce the diaphragm.

U.S. Pat. No. 5,782,345 to Guasch, et al. discloses a container including a bottom container closed at a bottom end and open at a top end and having a tubular neck. A top container open at a top end and closed at a bottom by a tearable seal contains a flap extending radially out from an exterior of the top container so that the flap surrounds the neck of the bottom container. A tubular sleeve has a bottom end and a top end, the bottom end defined by a beveled edge and the top end closed by a truncated cone, wherein the bottom end of the tubular sleeve being sized and shaped to be received within the open end of the top container. The tubular neck has a peripheral edge containing a first set of stria, and an interior of the tubular neck has a plurality of sealing rings. The top container engages the sealing rings of the bottom container, and the flap surrounds the neck of the bottom container, when the top container is inserted into the interior of the tubular neck. The bottom end of the tubular sleeve has a beveled edge with the top end being closed by a truncated cone. The tubular sleeve may be moved axially within the top container so that the beveled edge tears the tearable seal in the top container.

U.S. Pat. No. 5,927,549 to Wood discloses a dispensing structure provided for a container that has an opening to the container interior. The structure includes a body for extending around the container opening and a membrane for occluding the container opening. A cover is disposed over the membrane and is sealingly engaged with the body to accommodate axial sliding movement from an outer position to an inwardly displaced position. The cover defines a dispensing orifice and defines an edge for severing at least part of the membrane as the cover is moved from the outer position to the inwardly displaced position. An additive material may be initially stored in the dispensing structure above the membrane and can be combined with the product in the container after the membrane has been severed. A self-sealing, pressure-openable slit-type valve may be mounted in the cover at the dispensing orifice to control flow through the orifice.

U.S. Pat. No. 5,975,370 to Durliat discloses an attachment comprising a cylinder-embracing support portion at least partly encircling the upper end of the pump cylinder and having openings therein receiving hooks on the cylinder. Unitary with the support portion is a plunger hold-down portion that engages the upper end of the actuator portion of the plunger. The attachment has a tamper-evident frangible zone located between the cylinder-embracing support portion and the engagement with the actuator portion.

U.S. Pat. No. 6,290,100 to Yacko, et al. discloses a reusable concentrate cartridge adapted to be supported by a diluting and dispensing container for combining at least two separate components of a multi-component system. The concentrate cartridge has a hollow cylindrical body and a hollow tube with a closure portion. The concentrate cartridge is caused to open by the rotating engagement of a closure cap on the diluting and dispensing container to which causes the closure portion of the hollow tube to disengage to release the concentrate material.

U.S. Pat. No. 6,419,101 to Hessel, et al. discloses a closure that includes a closure orifice that is at least as large as the container orifice, thereby enhancing drinking and pouring. A non-living hinge or a two-joint, living hinge enables easy opening and pivoting of a top cover completely away from a closure orifice to enable a user to drink directly from the closure. The top cover includes a plug that seals the closure orifice. A tear band encircles most of the top cover and secures the lid to the base, and provides tamper resistance. After detaching the tear band, the closure may be pivoted open about the hinge to its fully open position.

U.S. Pat. No. 6,446,839 to Ritsche discloses a dispenser for the discharge and the atomizing of media, in which a liquid medium is discharged in one charge or a small number of partial charges in one operating stroke of an operating presser or trigger. The dispenser is secured against accidental operation and has a minimum packing or storage volume. Prior to each stroke, the operating presser is returned from an operating end portion to the operating starting position to commence the discharge stroke.

U.S. Pat. No. 6,447,743 to Devic, et al. discloses a dispensing closure system provided for a container. The system includes a body for extending from the container at the container opening. The body includes a base, a conduit that is reciprocatable relative to the base, and a flexible wall joining the conduit to the base. The conduit includes a dispensing aperture and a first seal surface. A spout is carried on, and is rotatable relative to, the body. The spout includes a dispensing orifice and a second seal surface for engaging the first seal surface. The body and spout together define a rotary-to-linear motion translation drive system that is responsive to the rotation of the spout in one direction for moving the conduit in a first direction to a closed position, and responsive to the rotation of the spout in the opposite direction for moving the conduit in a second direction opposite from the first direction to an open position.

U.S. Pat. No. 6,644,519 to Last discloses a container having a body, a male element, a female element and a plug. The female element comprises a body having an axial bore which extends through the body from an insertion opening outside the container body, to a seat inside the container body. The plug is positioned in the seat of the axial bore to close off the bore. The male element has a closure means and a tubular part which fits into the axial bore. The tubular part has a head and is designed to interact with the plug in order to press the plug off the seat. A passage extends through the tubular part of the male element to the closure means. The container body and the male element are provided with interacting coupling means that provides resistance to the male element being pulled outwards out of the bore.

U.S. Pat. No. 6,722,530 to King, et al. discloses a system for dispensing controlled amounts of flowable materials having a wide range of viscosities, such as food condiments, caulking or adhesives, from a flexible-walled container or bag. The system includes a housing for holding the flexible-walled container and a piston positioned within the housing to apply pressure to a wall of the flexible-walled container. An enfitment, which has a piercing member and sealing mechanism, is positioned adjacent an opposite wall of the flexible-walled container. By rotating the enfitment about a rotational axis generally normal to the wall of the first container, the enfitment forms an opening in the flexible-walled container and a seal with the container. The flowable material can then be forced through a hollow tube of the enfitment and an exit nozzle coupled to the enfitment. A desired amount of flowable material can be consistently dispensed from the flexible-walled container by controlling the displacement of the piston along a predetermined piston travel length for each dispensation of flowable material.

U.S. Pat. No. 6,758,372 to Studer, et al. discloses with soap and cleansing foam dispensers, there is a risk that they may be equipped with supply containers of unsuitable liquid or that their intermediate containers may become contaminated. According to the invention, an adapter that is mounted on an intermediate container has a coded cylindrical jacket, into which coded parts that are positioned on the neck of a suitable supply container can be fitted. To prevent the contamination of the intermediate container, the latter has a spring-loaded internal sealing plug which ensures the hygienic sealing of the container even prior to use and when the supply container is changed. To prevent interruptions in the operation, a reliable fill-level indicator is provided. The device thus ensures improved, hygienic dispensing of soap-solution in dispensers.

U.S. Pat. No. 6,997,351 to Cho discloses a bottle cap that has a spraying unit or a nipple cap, with a space defined therein to contain an additive, such as a detergent, brightening agent or powdered milk. The bottle cap includes: an immobile unit having a guide part tightened to the mouth of a bottle body, and a chamber part inserted into the mouth, with a breaking tip and a through hole provided in the bottom of the chamber part, and a pipe part provided along the central axis of the chamber part. A storage container has a cylinder part inserted into the chamber part, a breakable film covering the open lower end of the cylinder part. A hole extends through the storage container and receives the pipe part therein. An externally threaded part extends upward from the upper end of the cylinder part and engages with the guide part. A spraying unit has a cap part tightened to the externally threaded part, and a conduit pipe inserted into the pipe part. A spacing band is assembled around the externally threaded part at a position between the guide part and the cap part, thus spacing the spraying unit apart from the immobile unit by a predetermined interval. The spraying unit may be replaced with a nipple cap.

U.S. Pat. No. 7,337,921 to Ma discloses a closure for a container having an opening including a base cap and an overcap that form a sealed chamber adjacent the opening that is isolated from the contents of the container. The base cap includes an outer skirt having container-engaging structure, a cylindrical well, a frangible membrane connected to the well along an inclined line of weakness and by a hinge member. The hinge member includes a pocket extending downward adjacent lower and upper terminuses of the line of weakness. The overcap includes a body having gripping structure, an inner skirt received within and rotatably connected to the well, and a cutting member depending from a lower end of the inner skirt received within the pocket such that the cutting member extends below the upper terminus. The cutting member severs the line of weakness upon substantial rotation of the overcap with respect to the base cap.

Although the beverage vending machine manufactured under our U.S. Pat. No. 5,114,047 remains a successful commercial product to the present day, the beverage vending machine required the liquid to be shipped in a semi-rigid container and in a refrigerated condition. It would be desirable to provide anaseptic flexible container, a refrigerated flexible container or a non-refrigerated flexible container with or without preservatives for use with the beverage vending machine manufactured under our U.S. Pat. No. 5,114,047.

Therefore is an object of this invention is to provide an improved coupling for connecting a pump to a container wherein the container is an aseptic flexible container, a refrigerated flexible container or a non-refrigerated flexible container with or without preservatives.

Another object of this invention is to provide an improved coupling for connecting a pump to a container that may be retrofitted into existing beverage vending machines.

Another object of this invention is to provide an improved coupling for connecting a pump to a container that is inexpensive to add to beverage vending machines.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

A specific embodiment of the present invention is shown in the attached drawings. For the purpose of summarizing the invention, the invention is incorporated into an improved coupling connecting a pump to a container. In a first embodiment of the present invention, an improved coupling incorporates a slidable coupling sleeve for piercing a frangible seal for providing liquid communication from the container to the pump. The first embodiment of the present invention is suitable for use with an aseptic container. In a second embodiment of the present invention, an improved coupling provides liquid communication from the container to the pump. The second embodiment of the present invention is suitable for use with a refrigerated container or a non-refrigerated container with or without preservatives.

In a specific example of the first embodiment of the improved coupling, the liquid container comprises a fitment having an internal fitment bore communicating with the liquid container with a frangible seal sealing the internal fitment bore. The improved coupling comprises a coupling having a coupling sleeve defining a distal sleeve end with an internal coupling bore extending therethrough. The coupling is mounted to the pump for enabling the flow of liquid through the internal coupling bore from the distal sleeve end to the pump. The coupling sleeve is slidably received within the internal fitment bore of the fitment. A spacer is interposed between the coupling and the fitment for spacing the distal sleeve end of the coupling from the frangible seal. The spacer is removable for enabling the distal sleeve end of the coupling to slide within the internal fitment bore to pierce the frangible seal for providing liquid communication from the liquid container to the pump.

In a more specific embodiment of the invention, the coupling and the coupling sleeve are formed as a one-piece unit. Preferably, the removable spacer is secured to the coupling by a frangible connection. In one example, the removable spacer is a frangible collar interposed between the coupling and the fitment for inhibiting movement therebetween.

In another specific embodiment of the invention, the invention includes a first stop for locating the coupling in a first position relative to the fitment whereat the distal sleeve end is spaced from the frangible seal. An optional second stop is included for locating the coupling in a second position relative to the fitment whereat the distal sleeve end pierces the frangible seal.

In another example, the invention is incorporated into an improved coupling for connecting a mixing pump to a liquid container for pumping a first liquid from the liquid container and for mixing the first liquid with a second liquid within the pump. A fitment extends between an outer fitment end and an inner fitment end with the fitment affixed relative to the liquid container. An internal fitment bore extend through the fitment for enabling the introduction and discharge of the first liquid therethrough. An inner frangible seal is located relative to the inner fitment end of the fitment for sealing the internal fitment bore. A pump mounting is secured to the mixing pump. A coupling has a first coupling portion and a second coupling portion with the first coupling portion being secured to the pump mounting. A coupling sleeve extends from a second coupling portion defining a distal sleeve end. An internal coupling bore extends through the coupling for enabling the flow of liquid from the distal sleeve end to the mixing pump. The coupling sleeve is slidably received within the internal fitment bore of the fitment. A spacer is interposed between the coupling and the fitment for spacing the distal sleeve end of the coupling from the inner frangible seal. The spacer is removable for enabling the distal sleeve end of the coupling to slide within the internal fitment bore to pierce the inner frangible seal for providing liquid communication from the liquid container to the mixing pump.

In a more specific embodiment of the invention, the liquid container is a flexible container. The flexible container may be located with a generally rigid outer protective container. The fitment comprises a generally rigid cylindrical portion. An inner fitment flange and an outer fitment flange are secured to the inner fitment end and the outer fitment end, respectively. The inner frangible seal is affixed to the inner fitment flange of the fitment.

In a specific example of the second embodiment of the improved coupling, the container has a fitment defining an internal fitment bore communicating with the container. The improved coupling comprises a coupling having a first and a second coupling portion with an internal coupling bore extending therethrough. A first coupling engagement secures the first coupling portion of the coupling to the pump for enabling the flow of liquid through the internal coupling bore to the pump. A second coupling engagement secures the second coupling portion of the coupling to the fitment of the container for providing liquid communication from the container to the pump.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
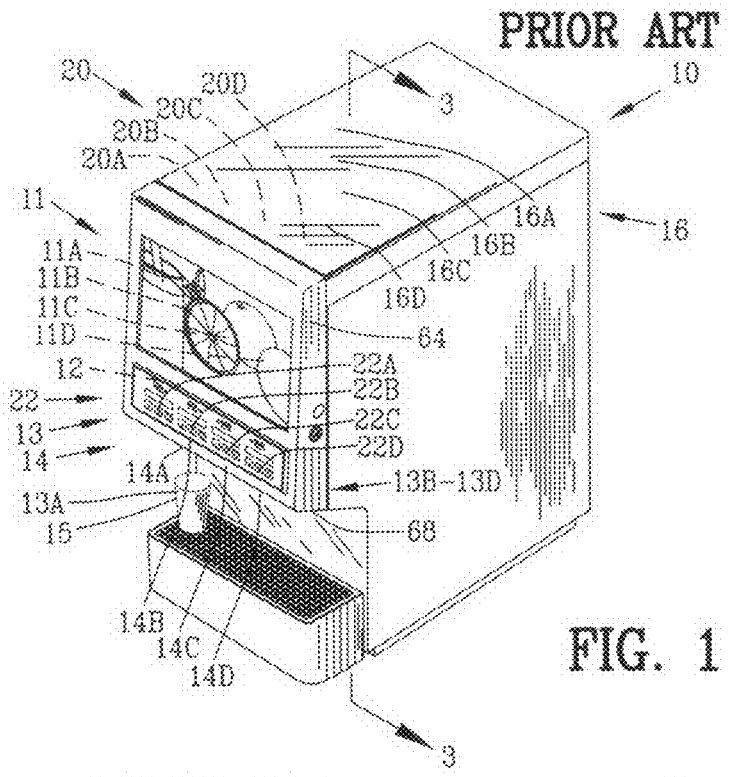
FIG. 1 is an isometric view of a dispenser system of the prior art.

FIG. 1 is an isometric view of a prior art dispenser device 10 for pumping a first liquid 11 and a second liquid 12. The dispenser device 10 mixes the first liquid 11 and the second liquid 12 to provide a mixed product 13 for discharge from a discharge aperture 14 into a vessel shown as a cup 15. In this example, the first liquid 11 is a first liquid concentrate 11 stored in a concentrate container 16 and the second liquid 12 is a second liquid diluent 12. Preferably, the second liquid diluent 12 is potable water.

The dispenser device 10 includes a pump and mixing device 20 controlled by an operator switch 22. Upon actuation of the operator switch 22, the pump and mixing device 20 pumps the first liquid concentrate 11 to mix with the second liquid diluent 12. The mixed first liquid concentrate 11 and the second liquid diluent 12 are discharged as the mixed product 13 from the discharge aperture 14 of the pump and mixing device 20.

In this specific example, the prior art dispenser device 10 includes four concentrate containers 16A-16D for storing four separate first liquid concentrates 11A-11D. In this example, the concentrate containers 16A-16D are formed of a substantially rigid polymeric material. The pump and mixing device 20 includes four separate pump and mixing devices 20A-20D controlled by four separate switches 22A-22D. The pump and mixing devices 20A-20D pump the four separate first liquid concentrates 11A-11D to mix with the common second liquid diluent 12 to provide four separate mixed products 13A-13D. The four separate mixed products 13A-13D are discharged from four separate discharge apertures 14A-14D.

Figure 2:
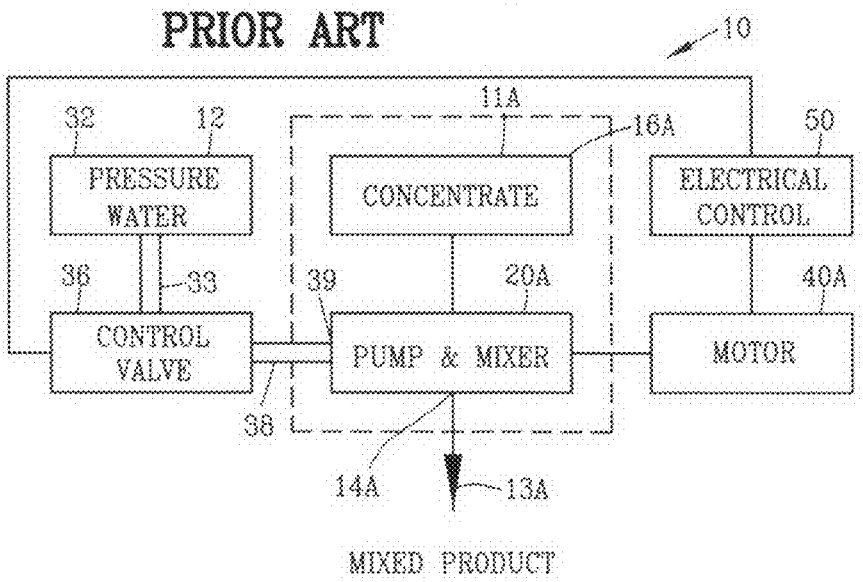
FIG. 2 is a block diagram of the dispenser system of FIG. 1.

FIG. 2 is a block diagram illustrating the mechanism of the dispenser device 10 of the pump and mixing device 20A of FIG. 1. The concentrate container 16A communicates with the pump and mixing device 20A for enabling the pump and mixing device 20A to pump the first liquid concentrate 11A. A pressurized source 32 of the second liquid diluent 12 is connected through a conduit 33 and a control valve 36 and conduit 38 to a second liquid input 39 of the pump and mixing device 20A. A motor 40A is connected to the pump and mixing device 20A for driving the pump and mixing device 20A.

An electrical control 50 is connected to operate the control valve 36 and the motor 40A. Upon actuation of the switch 22A, the second liquid diluent 12 flows through the control valve 36 and conduit 38 into the pump and mixing device 20A. Simultaneously, the pump and mixing device 20A pumps the first liquid concentrate 11A from the concentrate container 16A. The movement of the pump and mixing device 20A by the motor 40A pumps and mixes the first liquid concentrate 11A with the second liquid diluent 12 to discharge the mixed product 13A from the discharge aperture 14A.

Figure 3:
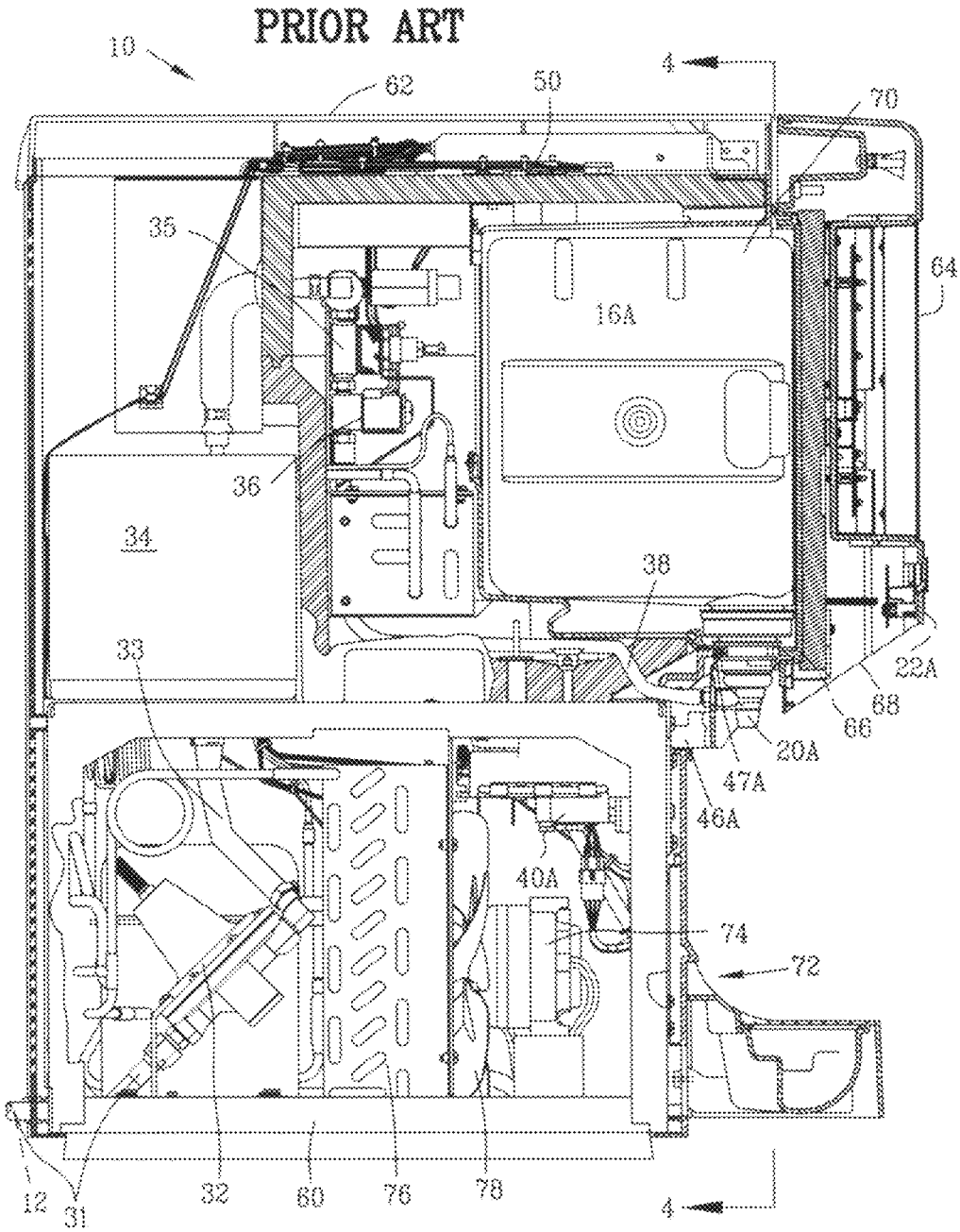
FIG. 3 is a sectional view along line 3-3 in FIG. 1.
Figure 4:
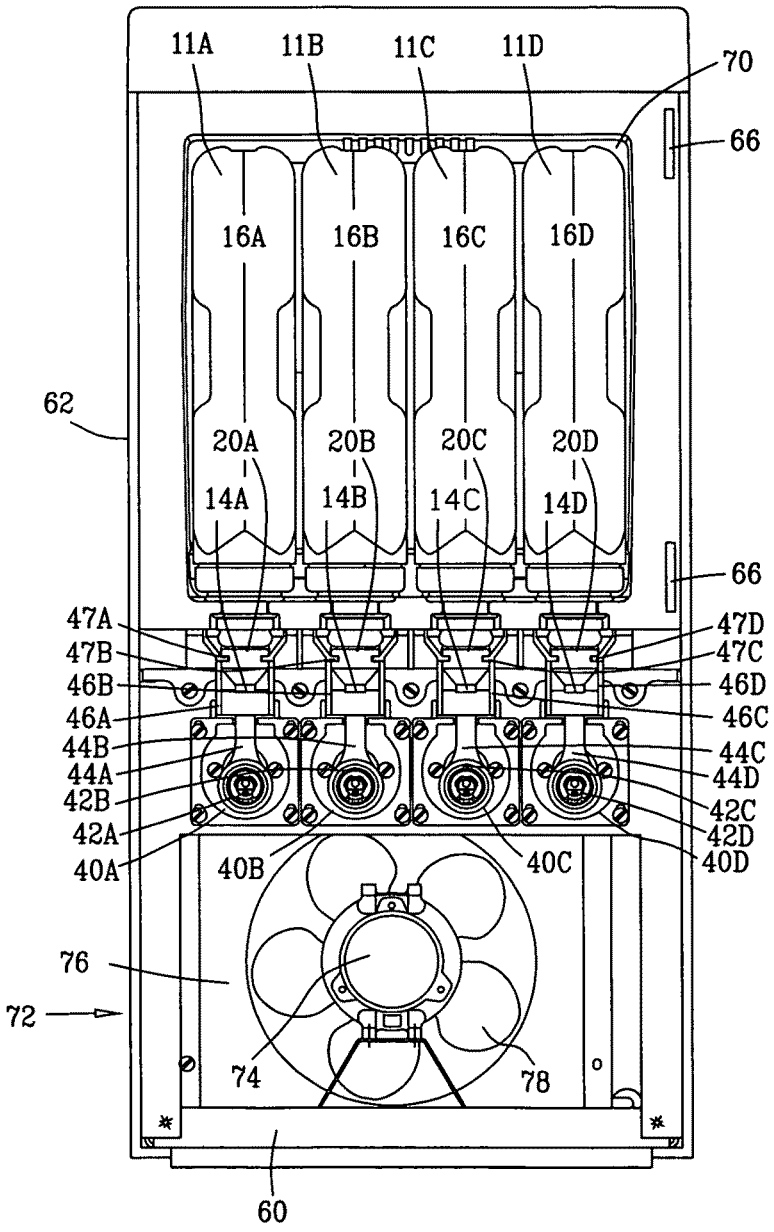
FIG. 4 is a sectional view along line 4-4 in FIG. 3.

FIGS. 3 and 4 are enlarged sectional views illustrating the interior of the dispenser device 10 shown in FIG. 1. The dispenser device 10 comprises a frame 60 for supporting various components of the dispenser device 10 including an outer covering shroud 62. A front door 64 is pivotably mounted to the frame 60 by hinges 66 for enabling an operator to access an interior of the dispenser device 10. The front door 64 includes a front door bottom 68.

The second liquid diluent 12 shown as water enters under conventional water pressure through an input conduit 31. The input conduit 31 is connected through a liquid pressure regulator 32 and a conduit 33 to a reservoir 34. A circulating pump 35 circulates the second liquid diluent 12 between the reservoir 34 and a refrigerated compartment 70 for maintaining the second liquid diluent 12 at a proper temperature for use. The control valve 36 controls the flow of the second liquid diluent 12 from the reservoir 34 to pumping and mixing devices 20A-20D through the flexible conduit 38.

A refrigeration unit 72 maintains the refrigerated compartment 70 at a reduced temperature. The refrigeration unit 72 includes a motor 74, a compressor 76 and a fan 78 connected in a conventional arrangement.

The pump and mixing devices 20A-20D are connected to the concentrate containers 16A-16D. The concentrate containers 16A-16D and the attached pump and mixing devices 20A-20D are loaded into and removed from the refrigerated compartment 70 through the front door 64. The refrigerated compartment 70 maintains the first liquid concentrates 11A-11D at a proper temperature for storage and use.

The pumping motors 40A-40D include eccentrics 42A-42D for reciprocating driving arms 44A-44D. The reciprocating driving arms 44A-44D are connected through pivoting arms 46A-46D and plural coupling fingers 47A-47D to operate the pump and mixing devices 20A-20D.

When the concentrate containers 16A-16D and the attached pump and mixing devices 20A-20D are inserted within the refrigerated compartment 70 the attached pump and mixing devices 20A-20D are connected simultaneously to the conduit 38 and to the coupling fingers 47A-47D.

The electrical control 50 operates the dispenser device 10 in response to the operator switches 22A-22D. Upon activation of one of the operator switches 22A-22D, the electrical control 50 energizes flow control valve 38 and a selected one of the pumping motors 40A-40D for mixing the liquid diluent 12 with a selected one of the concentrates first liquid concentrates 11A-11D from the containers concentrate containers 16A-16D to produce one of the mixed product 13A-13D.

Figure 5:
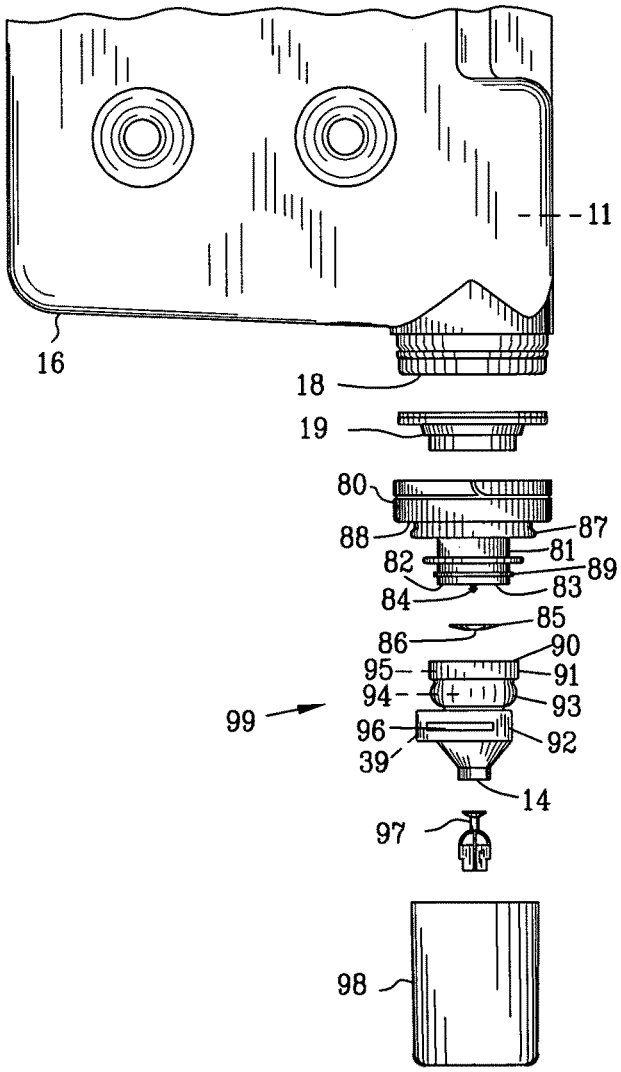
FIG. 5 is a magnified exploded view of a pump and a container of FIG. 3.

FIG. 5 is a magnified exploded view of one of the pump and mixing device 20A-20D and the concentrate container 16A-16D of FIG. 3. A resilient gasket 19 is received within an opening 18 of the container 16 for seal the container cap 80 to the container 16. The container cap 80 is sealed to the container 16 to prevent the unauthorized removal of the container cap 80.

The container cap 80 comprises a sidewall 81 connected to an endwall 82 having an endwall aperture 83. A projection 84 extends from the endwall 82 for mounting an input one-way valve 85 through an engagement with a central orifice 86. The first liquid concentrate 11 is discharged from the concentrate container 16 upon opening of the input one-way valve 85.

A vent hole 88 is defined in the container cap 80 for cooperating with the resilient gasket 19 to provide a vent valve for venting the concentrate container 16. The vent hole enables ambient air to enter the concentrate container 16 for venting the concentrate container 16 as the first liquid concentrate 11 internal the concentrate container 16 is depleted during use of the pumping and mixing device 20. The container cap 80 supports an annular boss 89 for mounting the pump and mixing device 20.

The pumping and mixing device 20 comprises a body member 90 having an input body portion 91 and an output body portion 92 with a flexible wall 93 interconnecting the input body portion 91 and the output body portion 92. A pumping chamber 94 is defined between the input body portion 91 and an output body portion 92 by the flexible wall 93. The input body portion 91 includes a recess 95 for receiving the annular boss 89 for mounting the pump and mixing device 20 to the container cap 80 of the container 16. Plural recesses 96 are defined in the output body portion 92 of the pumping and mixing device 20 for receiving the plural coupling fingers 47A-47D extending from the pivoting arms 46A-46D of the pumping motors 40A-40D. The second liquid input 39 of the pump and mixing device 20A is defined in the output body portion 92 of the pumping and mixing device 20. An output one-way valve 97 is located within the pump and mixing device 20 as shown in FIGS. 6 and 7.

An overcap 98 removably engages with the container cap 80 for covering the pumping and mixing device 20 to prevent contamination during shipment and storage. The overcap 98 is secured to the container cap 80 in a snap locking engagement for covering the pumping and mixing device 20 to prevent contamination during shipment and storage.

The resilient gasket 19, the container cap 80, the input one-way valve 85, the body member 90 and the output one-way valve 97 as well as the overcap 98 are assembled to form a subassembly 99. After the concentrate container 16 is filled with the liquid concentrate 11, the subassembly 99 is sealed to the concentrate container 16 when the container cap 80 is sealed to the concentrate container 16.

Figure 6:
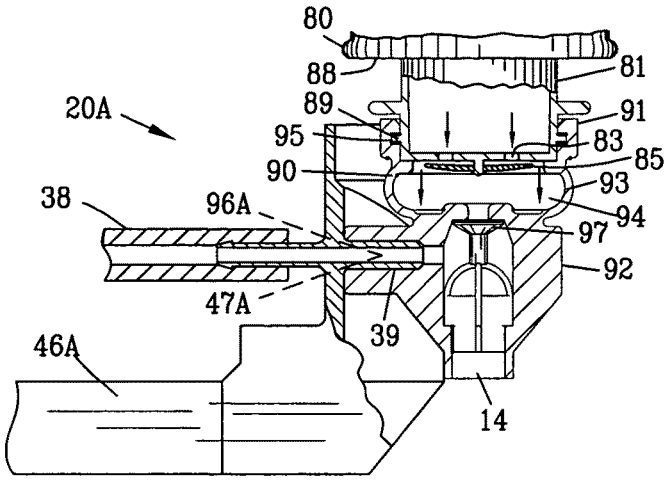
FIG. 6 PRIOR ART
FIG. 6 is a magnified view of a pump portion of FIG. 3 in a first pumping position.
Figure 7:
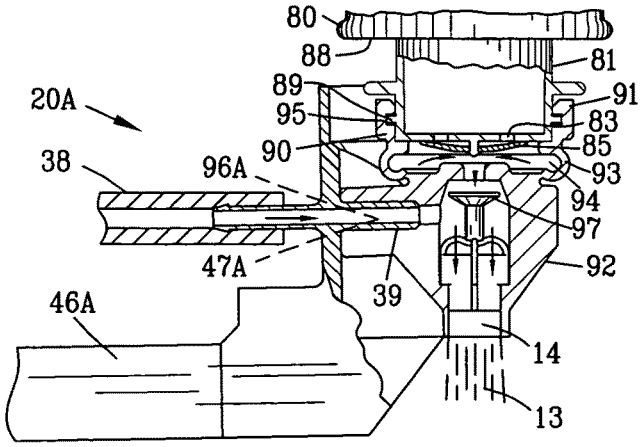
FIG. 7 is a view similar to FIG. 5 with the pump portion in a second pumping position.

FIG. 6 is an enlarged view of the pumping and mixing device 20A and the pumping motor 40A in FIG. 4 shown in a first position. Referring back to FIGS. 3 and 4, the pumping motor 40A drives the eccentric 42A for reciprocating the driving arm 44A for pivoting the pivot arm 46A and the plural coupling fingers 47A. The plural recesses 96A of the output body portion 92 receive the plural coupling fingers 47A extending from the pivot arm 46A. The flexible conduit 38 provides a fluid coupling between the flow control valve 36 and the reciprocating output body portion 92 of the pumping and mixing device 20A.

When the pumping motor 40 rotates, the pivot arm 46A and the plural coupling fingers 47A move the output body portion 92 relative to the input body portion 91 of the pumping and mixing device 20A between the first position shown in FIG. 6 and the second position shown in FIG. 7. The pumping chamber 94 pumps the liquid concentrate 11A from the container 16A to mix with the liquid diluent 12 entering into the second liquid input 39 when the output body portion 92 is moved between the first and second position as shown in FIGS. 6 and 7, respectively.

When the pumping motor 40A reciprocates the output body portion 92 from the second position shown in FIG. 7 to the first position shown in FIG. 6, the volume of the pumping chamber 94 expands thereby reducing the pressure internal the pumping chamber 94. The reduced pressure internal the pumping chamber 94 closes the output one-way valve 97 and opens the input one-way valve 85 to permit the flow of liquid concentrate 11A into the pumping chamber 94.

When the pumping motor 40A reciprocates the output body portion 92 from the first position shown in FIG. 6 into the second position shown in FIG. 7, the volume of the pumping chamber 94 contracts thereby increasing the pressure internal the pumping chamber 94. The increased pressure internal the pumping chamber 94 opens the output one-way valve 97 and closes the input one-way valve 85 to permit the flow of liquid concentrate 11A from the pumping chamber 94 through the discharge aperture 14A. As the concentrate 11A internal the concentrated container 16A is depleted during use, the vent valve 88 opens to permit the flow of air into the concentrated container 16 to maintain an ambient air pressure within the concentrate container 16A.

The prior art dispenser device 10 shown in FIGS. 1-7 is set forth in U.S. Pat. No. 5,114,047 entitled Pump and Mixing Device for Liquids issued to Richard D. Baron et al. which is incorporated by reference into the present application as if fully set forth herein. Although the present invention is set forth with reference to the prior art dispenser device 10 shown in U.S. Pat. No. 5,114,047, it should be understood that the present invention may be used with other types, styles and configurations of dispenser devices.

Figure 8:
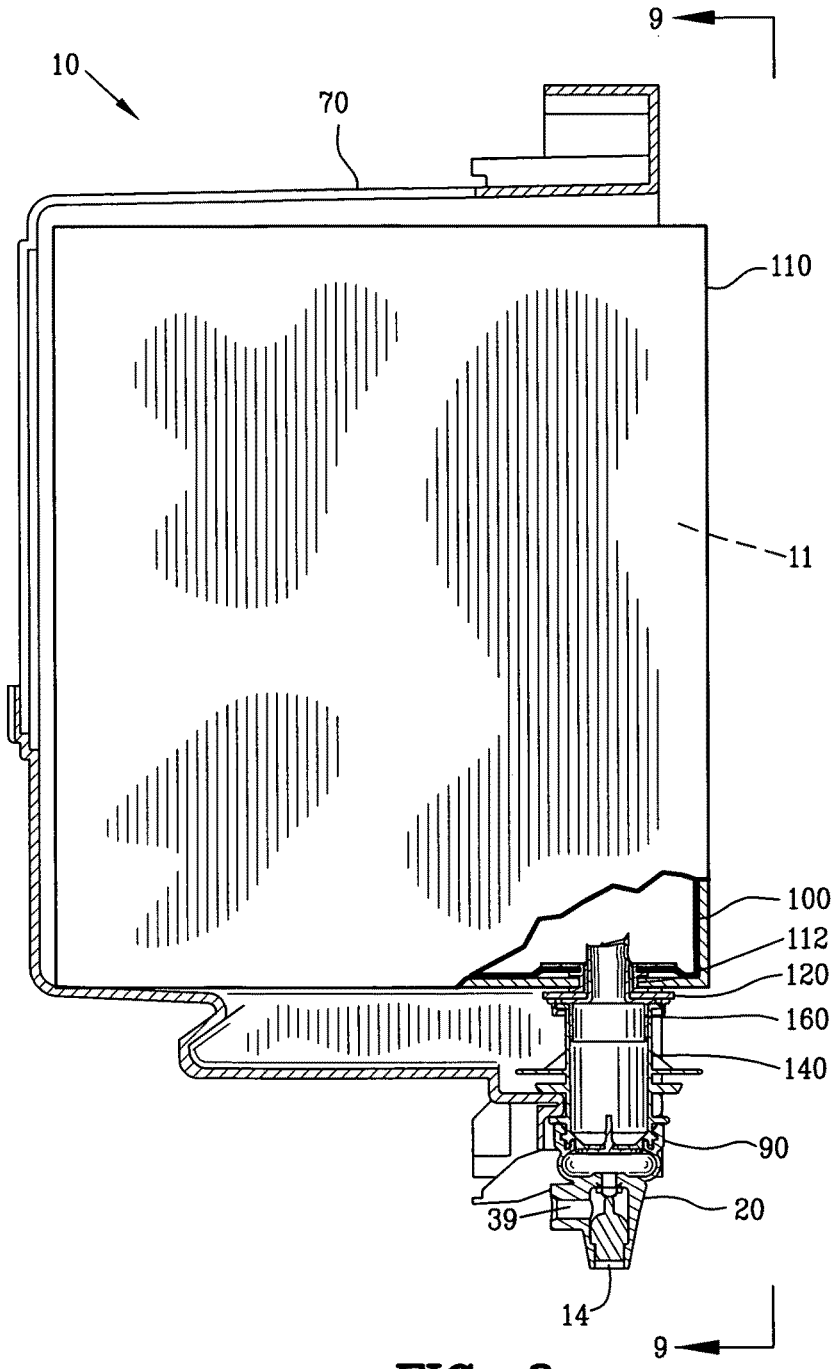
FIG. 8 is a side sectional view similar to a portion of FIG. 3 illustrating the coupling of the present invention connecting a liquid container to a pump.

FIG. 8 is a side sectional view similar to a portion of FIG. 3 illustrating a liquid container 100 enclosed within an outer protective container 110 located within the refrigerated compartment 70 in the prior art dispenser device 10 shown in FIGS. 1-4. The liquid container 100 includes a fitment 120 for connecting the liquid container 100 to the pump and mixing device 20 through a pump mounting 140 and a coupling 160 of the present invention.

Figure 9:
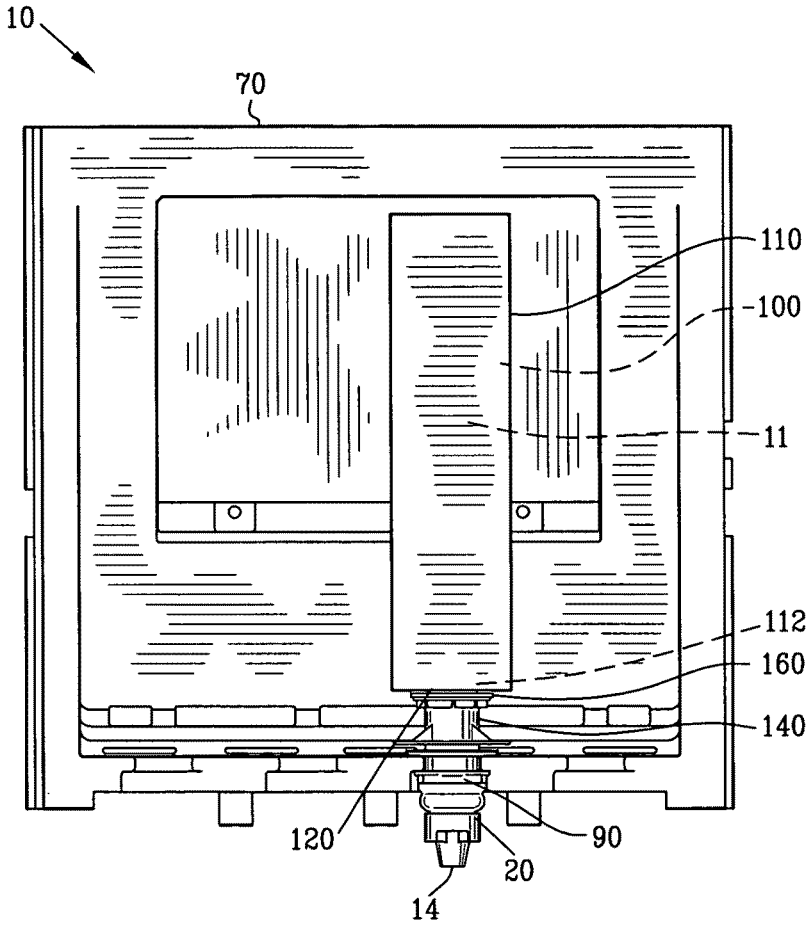
FIG. 9 is a view along line 9-9 in FIG. 8.

FIG. 9 is a view along line 9-9 in FIG. 8 illustrating the liquid container 100 within the outer protective container 110 inserted within the refrigerated compartment 70 in the prior art dispenser device 10. In this embodiment, the outer protective container 110 is similar in dimensions of the container 16 to enable the liquid container 100 within the outer protective container 110 to be inserted within the prior art dispenser device 10 shown in FIGS. 1-4. The pump mounting 140 and the coupling 160 of the present invention enables the liquid container 100 to be used with the pump and mixing device 20 of shown in U.S. Pat. No. 5,114,047. A more detailed explanation of the liquid container 100 and the outer protective container 110 and the fitment 120 will be forthcoming with reference to FIGS. 16-19.

Figures 10, 11, 12, 13:
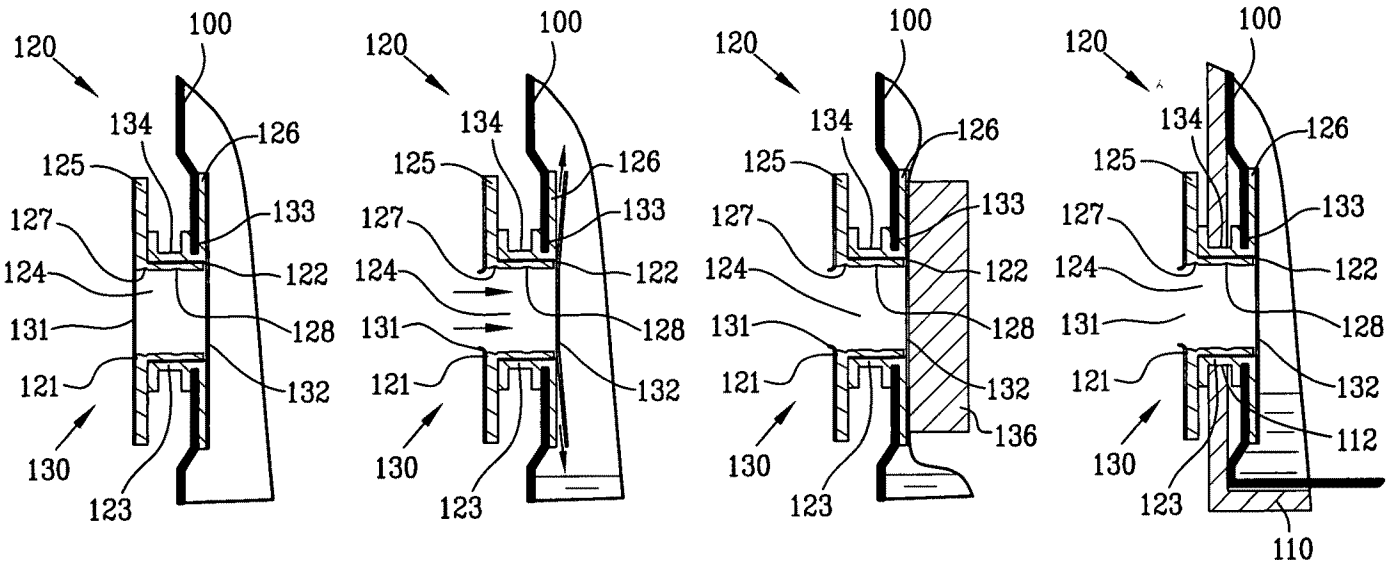
FIG. 10 is a side sectional view of the liquid container in a rotated position prior to filling with a liquid.
FIG. 11 is a view similar to FIG. 10 illustrating the filling of the liquid container.
FIG. 12 is a view similar to FIG. 11 illustrating the sealing of an inner frangible seal of the liquid container.
FIG. 13 is a view similar to FIG. 12 illustrating the addition of an optional protective container.

FIG. 10 is a side sectional view of the liquid container 100 in a rotated position prior to filling with a liquid 11. The liquid container 100 is a flexible container connected to the fitment 120. The fitment 120 extends between an outer fitment end 121 and an inner fitment end 122 with the inner fitment end 122 affixed to the liquid container 100. The fitment 120 is formed as a rigid cylindrical portion 123 having an internal fitment bore 124 extending therethrough. The internal fitment bore 124 extending through the fitment 120 enables the introduction and discharge of the liquid 11 there through. Preferably, the outer fitment end 121 is joined to the inner fitment end 122 by suitable means such as a snap locking engagement, ultrasonic welding, adhesives or the like.

An outer fitment flange 125 and an inner fitment flange 126 are secured to the outer and inner fitment ends 121 and 122. A first bore depression 127 is formed in the internal fitment bore 124 in proximity to be outer fitment end 121. A second bore depression 128 is formed in the internal fitment bore 124 in proximity to be inner fitment end 122.

A frangible seal 130 is provided for sealing the internal fitment bore 124 of the fitment 120. In this example, an outer frangible seal 131 is secured to the outer fitment flange 125 and an inner frangible seal 132 is secured to the inner fitment flange 126.

The fitment 120 is provided with a liquid container recess 133 and a protective container recess 134. The liquid container recess 133 is provided for mounting the liquid container 100 to the fitment 120. The protective container recess 134 is provided for mounting an optional outer protective container 110. Typically, the optional outer protective container 110 is used for shipping liquid container 100. In this example, the outer protective container 110 is shown as a substantially rigid outer protective container 110 having an open aperture 112 as shown in FIG. 13. The outer protective container 110 may be inserted within the prior art dispensing device 10 but it should be understood that the present invention may be used to with or without the optional outer protective container 110.

FIG. 11 is a view similar to FIG. 10 illustrating the filling of the liquid container 100. In this example, the liquid container 100 is shown as an aseptic container wherein the liquid container 100, the fitment 120 and the outer and inner frangible seals 131 and 132 are shipped in a sterile condition. The outer region of the liquid container 100 in proximity to the fitment 120 is clean prior to the filling process. A filling head (not shown) pierces the outer frangible seal 131 to fill the liquid container 100 with the liquid 11. The inner frangible seal 132 is partially affixed to the inner fitment flange 126 to permit the flow of the liquid 11 into the container 100.

FIG. 12 is a view similar to FIG. 11 illustrating the sealing of an inner frangible seal 132 of the liquid container 100. After the filling out the liquid container 100, a sealer 136 seals the inner frangible seal 132 to the inner fitment flange 126.

FIG. 13 is a view similar to FIG. 12 illustrating the addition of the optional outer protective container 110. The open aperture 112 in the outer protective container 110 is inserted into the protective container recess 134 for mounting the optional outer protective container 110 to the fitment 120.

Figures 14, 15:
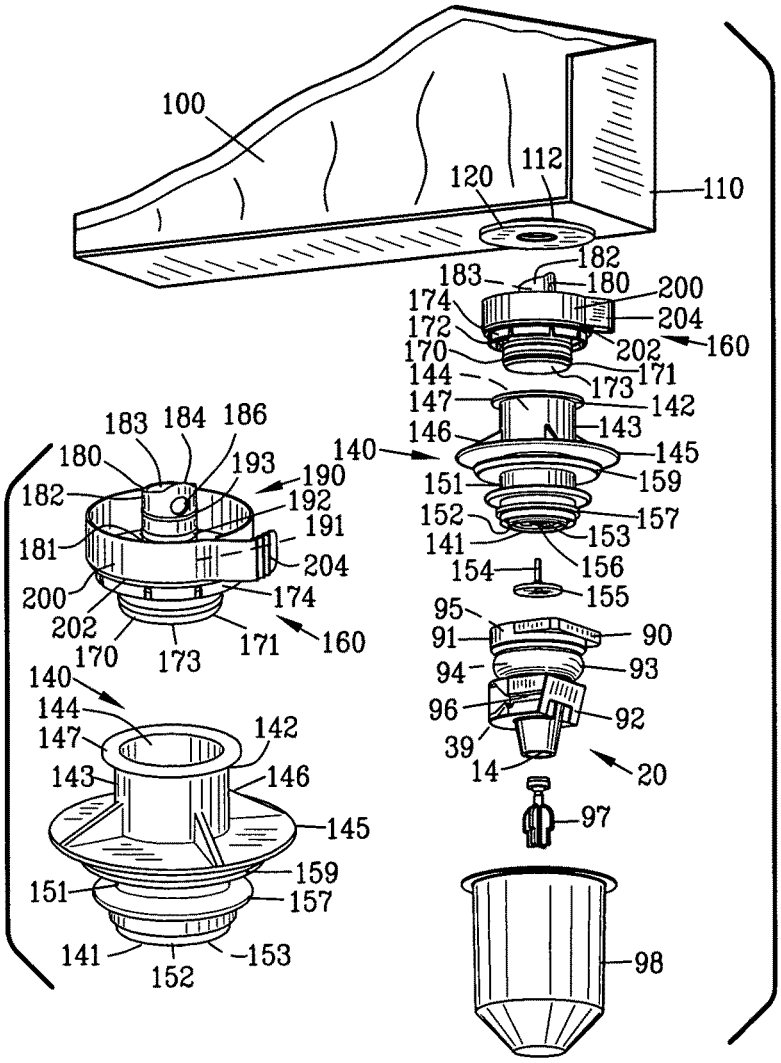
FIG. 14 is an enlarged exploded lower isometric view of the coupling of the present invention connecting the liquid container to the pump.
FIG. 15 is an enlarged upper isometric view of a portion of FIG. 14.
Figure 17:
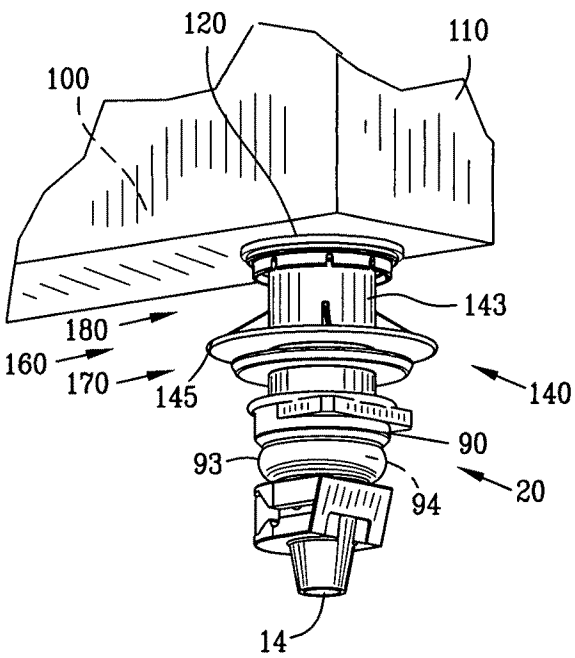
FIG. 17 is a view similar to FIG. 16 with the spacer removed and the coupling moved into a second position with the distal sleeve end piercing the frangible seal.
Figure 16:
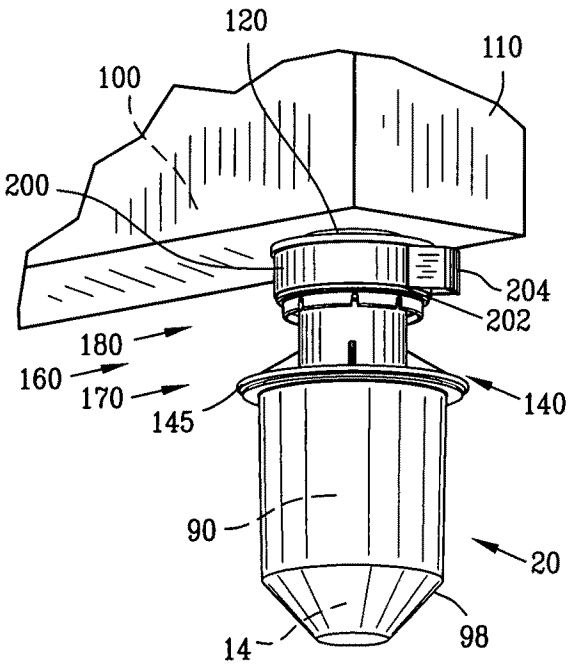
FIG. 16 is an enlarged assembled view of FIG. 14 illustrating a spacer locating the coupling in a first position with a distal sleeve end spaced from a frangible seal.
Figure 19:
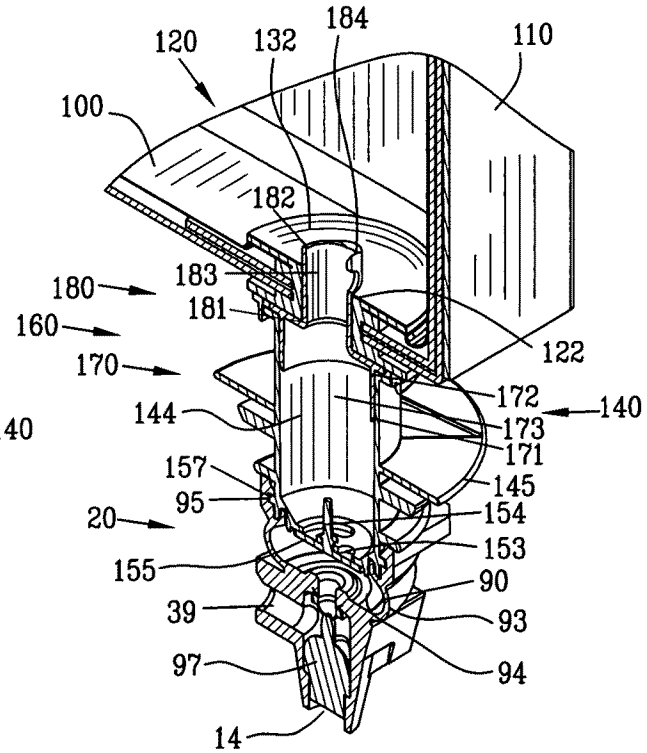
FIG. 19 is a top isometric sectional view of FIG. 17.
Figure 18:
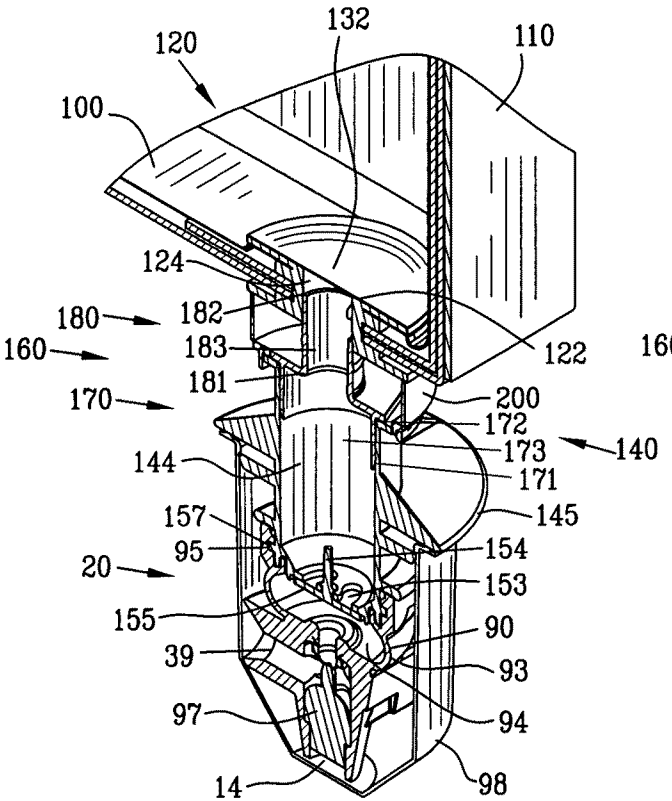
FIG. 18 is a top isometric sectional view of FIG. 16.

FIG. 14 is an enlarged exploded lower isometric view of the coupling 160 of the present invention connecting the liquid container 100 to the pump 20. In a manner similar to FIG. 5, the pumping and mixing device 20 comprises a body member 90 having an input body portion 91 and an output body portion 92 with a flexible wall 93 interconnecting the input body portion 91 and the output body portion 92 defining a pumping chamber 94. An annular indentation 95 is defined within the input body portion 91 for mounting the pump and mixing device 20 to a pump mounting 140. A plural recess 96 is defined in the output body portion 92 for receiving the plural coupling fingers 47A extending from the pivot arm 46A as shown in FIG. 4. An output one-way valve 97 is located within the pump and mixing device 20. An overcap 98 removably engages with the pump mounting 140 for covering the pumping and mixing device 20 to prevent contamination during shipment and storage.

FIG. 15 is an enlarged upper isometric view of a portion of FIG. 14. The pump mounting 140 comprises a first mounting portion 141 and a second mounting portion 142 forming a cylindrical member 143 having a cylindrical aperture 144. A support disk 145 is defined between the first mounting portion 141 and the second mounting portion 142.

The second mounting portion 142 comprises a plurality of ribs 146 extend from the cylindrical member 143 to reinforce the support disk 145. A flange 147 extends outwardly from the second mounting portion 142 for connection to the coupling 160 as will be described in greater detail hereinafter.

The first mounting portion 141 of the pump mounting 140 is similar to the container cap 80 shown in FIG. 5. The first mounting portion 141 comprises a sidewall 151 and an endwall 152 having an endwall aperture 153.

Referring back to FIG. 14, a projection 154 of the input one-way valve 155 is received within a central orifice 156 for securing the input one-way valve 155 to the pump mounting 140. An annular boss 157 extends outwardly from the sidewall 151 for extending into the recess 95 of the input body portion 91 of the body member 90 for mounting the pump and mixing device 20 to a pump mounting 140. An annular projection 159 extends outwardly from the sidewall 151 for engaging with the overcap 98 in a snap locking engagement for securing the overcap 98 to the pump mounting 140 for covering the pumping and mixing device 20 to prevent contamination during shipment and storage.

The coupling 160 comprises a first coupling sleeve 170 and a second coupling sleeve 180. The first coupling sleeve 170 extends between a proximal end 171 and a distal end 172 with a first coupling sleeve bore 173 extending therethrough. A coupling engagement 174 extends from the first coupling sleeve 170 for securing to the flange 147 extending from the second mounting portion 142 of the pump mounting 140 in a snap locking engagement. In addition, the coupling engagement 174 may be joined with the flange 147 by an ultrasonic welding process. The cooperation of the coupling engagement 174 with the flange 147 secures the coupling 160 to the pump mounting 140. The first coupling sleeve bore 173 of the coupling engagement 174 enables the flow of the liquid 11 through the first coupling sleeve bore 173 of the coupling 160 to the pump 20.

The second coupling sleeve 180 extends between a proximal end 181 and a distal end 182 with a second coupling sleeve bore 183 extending therethrough. The second coupling sleeve bore 183 enables the flow of the liquid 11 to the pump 20. The distal end 182 of the second coupling sleeve 180 defines an apex point 184 and an orifice 186. Preferably, the coupling 160 including the first and second coupling sleeves 170 and 180 are formed as a one-piece unit.

The second coupling sleeve 180 comprises stops 190 for determining the relative position between the coupling 160 and the fitment 120. As will be described in greater detail hereinafter, the second coupling sleeve 180 comprises stops 191-193 for establishing a first and a second position of the coupling 160 relative to the fitment 120. Each of the stops 191-193 is a projection extending outwardly from the second coupling sleeve 180. Preferably, each of the stops 191-193 is tapered to facilitate insertion and inhibit removal of the second coupling sleeve 180 into the internal fitment bore 124.

A spacer 200 is connected to the coupling 160 by a frangible connector 202. In this example, the spacer 200 is shown as a frangible collar having a pull tab 204. The spacer 200 may be removed from the coupling 160 by an operator pulling on the pull tab 204 to sever the frangible connector 202.

FIGS. 16, 18, 20 and 22 are various enlarged assembled views of FIG. 14 illustrating the coupling 160 inserted into the fitment 120. The distal end 182 of the second coupling sleeve 180 is slidably received within the internal fitment bore 124 of the fitment 120. The coupling 160 is positioned in a first position relative to the fitment 120. In the first position, the distal end 182 of the second coupling sleeve 180 is spaced from the inner frangible seal 132 sealing the fitment 120.

The spacer 200 is interposed between the coupling 160 and the fitment 120. The spacer 200 is secured to the coupling 160 by the frangible connector 202. The spacer 200 prevents movement of the coupling 160 toward the fitment 120. The spacer 200 positions the coupling 160 from the fitment 120 for spacing the distal end 182 of the second coupling sleeve 180 from the inner frangible seal 132.

Figure 20:
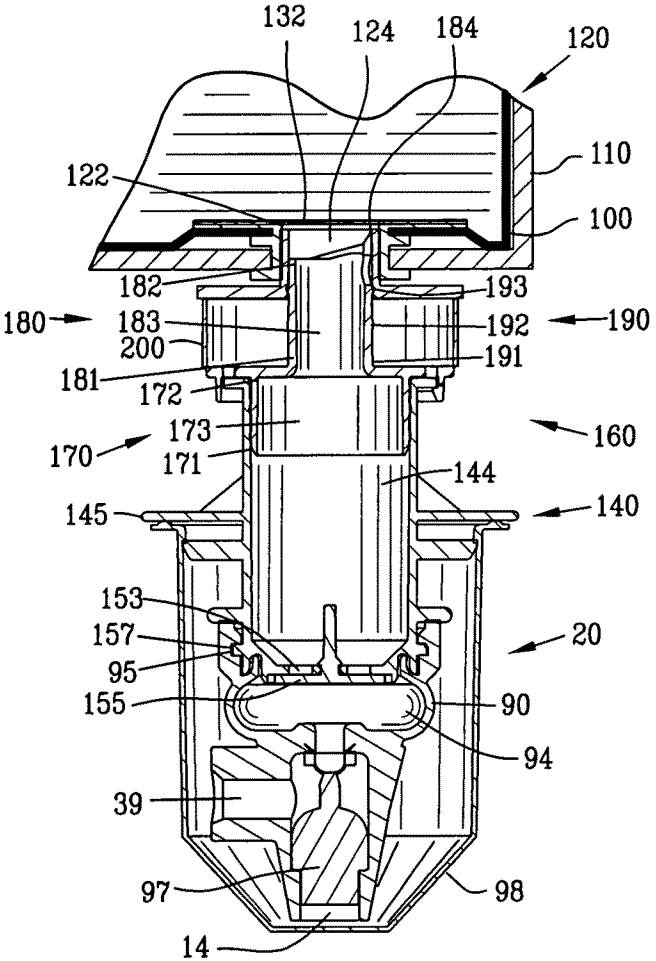
FIG. 20 is a magnified side sectional view of the spacer locating the coupling in a first position as previously shown in FIGS. 16 and 18 with a distal sleeve end spaced from the frangible seal.
Figure 22:
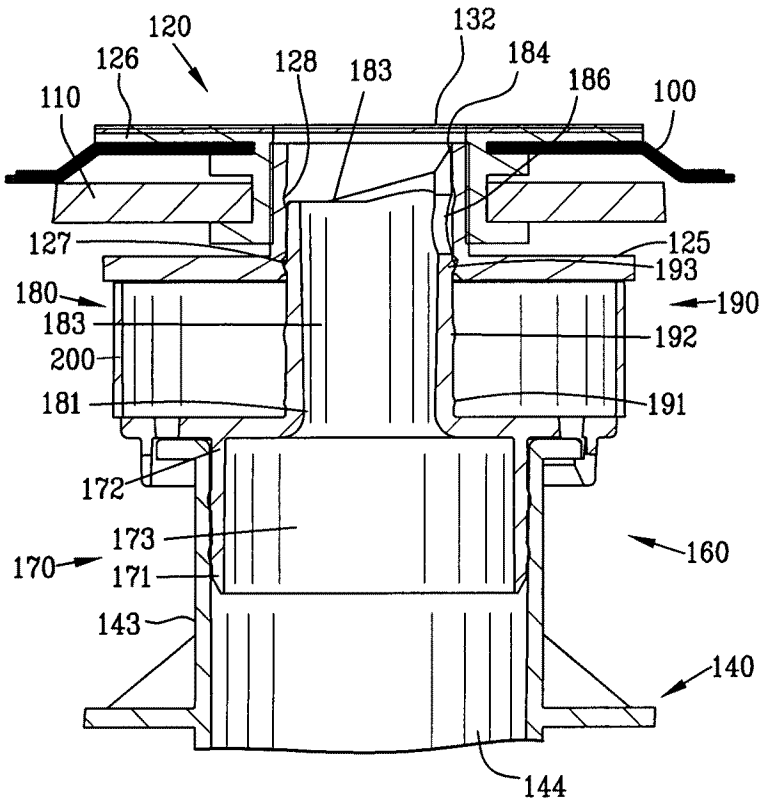
FIG. 22 is a further magnified view of a portion of FIG. 20 illustrating a first stop for maintaining the coupling in the first position.

As best shown in FIGS. 20 and 22, the stop 193 on the second coupling sleeve 180 is received within the first bore depression 127 of the internal fitment bore 124 of the fitment 120. The stop 193 received within the first bore depression 127 inhibits removal of the second coupling sleeve 180 from the internal fitment bore 124 of the fitment 120. The engagement of the stop 193 within the first bore depression 127 prevents removal of the pump and mixing device 20 from the container 100.

FIGS. 17, 19, 21 and 23 are various enlarged assembled views of FIG. 14 illustrating the removal of the spacer 200 from the coupling 160. The spacer 200 has been removed by an operator pulling on the pull tab 204 to sever the frangible connector 202. The removal of the spacer 200 permits movement of the coupling 160 toward the fitment 120 into the second position. The movement of the coupling 160 toward the fitment 120 within the internal fitment bore 124 enables the apex point 184 of the second coupling sleeve 180 to pierce the inner frangible seal 132.

In the second position, the distal sleeve end 182 of the coupling 160 extends through and beyond the inner frangible seal 132 of the fitment 120. The liquid 11 in the liquid container 100 flows directly through the second coupling sleeve bore 183 and the first coupling sleeve bore 173 to the pump 20.

Figure 21:
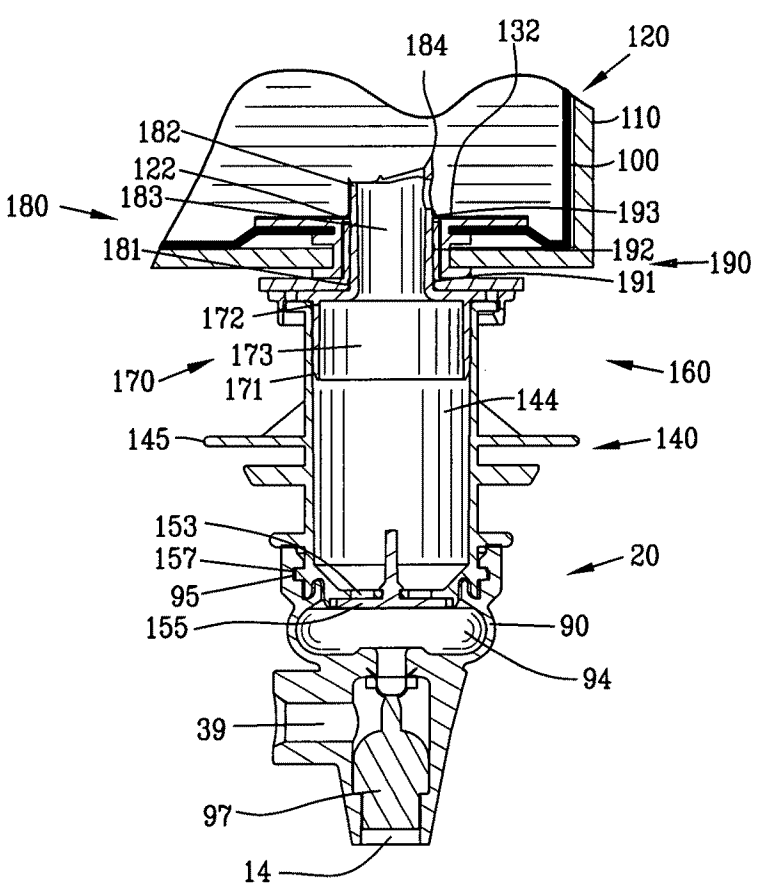
FIG. 21 is a view similar to FIG. 20 with spacer removed and with the coupling moved into a second position as previously shown in FIGS. 17 and 19 with the distal sleeve end piercing the frangible seal.
Figure 23:
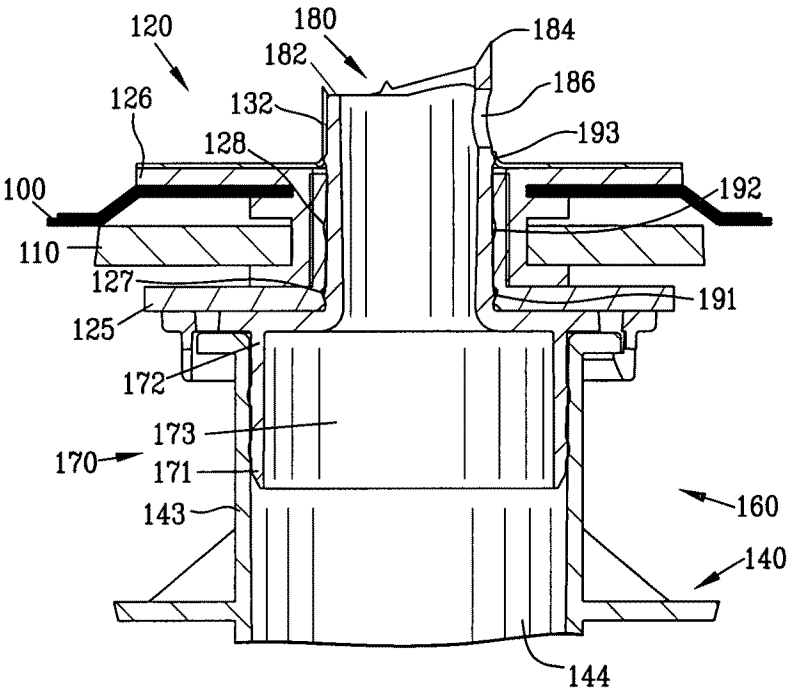
FIG. 23 is a further magnified view of a portion of FIG. 21 illustrating a second stop for maintaining the coupling in the second position.

As best shown in FIGS. 21 and 23, the stops 191 and 192 on the second coupling sleeve 180 are received within the first and the second bore depressions 127 and 128, respectively. In addition, the stop 193 on the second coupling sleeve 180 engages with the inner fitment flange 126. The engagement of stops 191 and 192 with the bore depressions 127 and 128 along with the engagement of stop 193 with the inner fitment flange 126 inhibits removal of the second coupling sleeve 180 from the internal fitment bore 124 of the fitment 120 and therefore prevents removal of the pump and mixing device 20 from the container 100.

Figure 24:
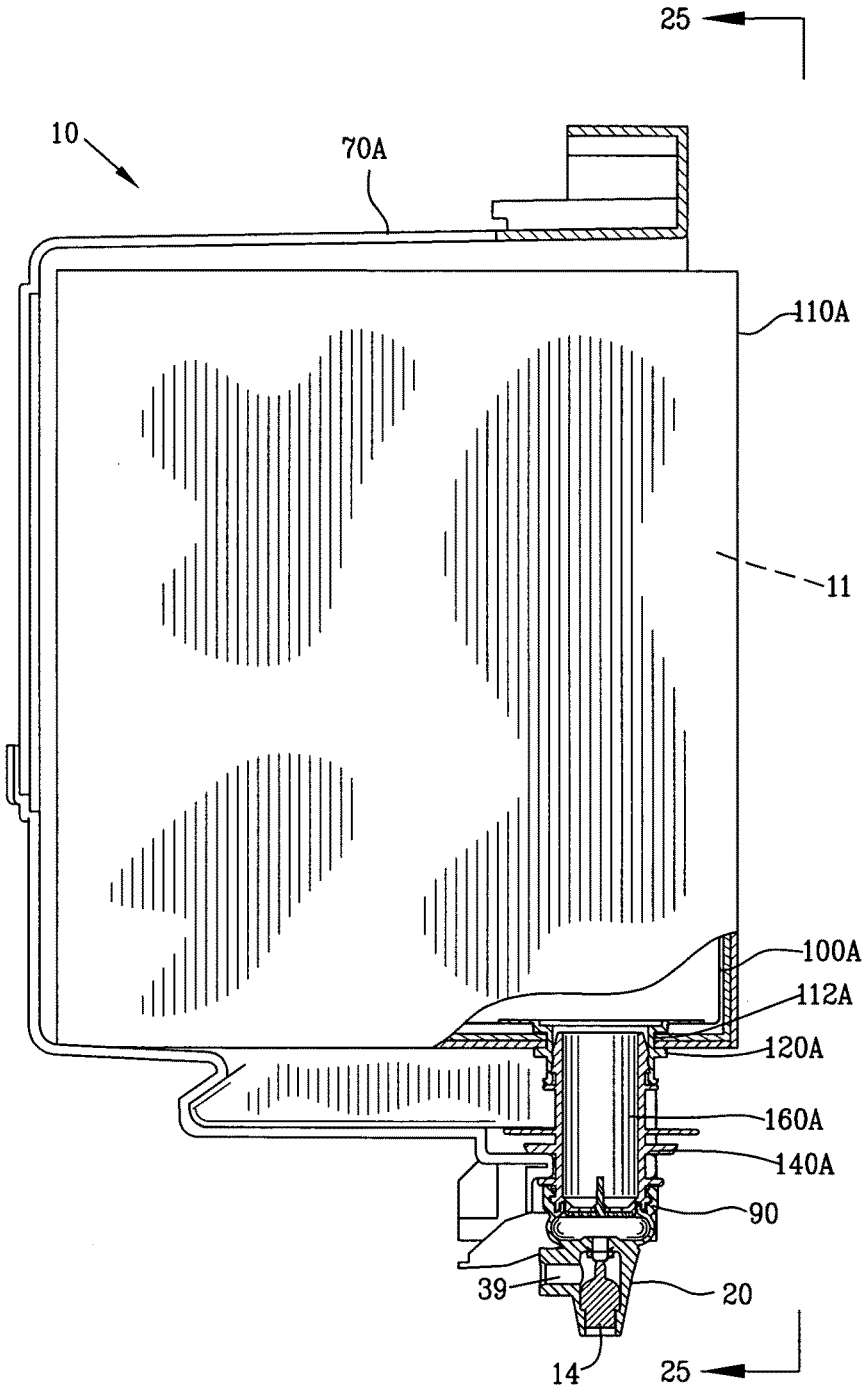
FIG. 24 is a side sectional view similar to a portion of FIG. 3 illustrating a second embodiment of the coupling of the present invention connecting a liquid container to a pump.

FIG. 24 is a side sectional view similar to a portion of FIG. 3 illustrating a second embodiment of coupling 160A of the present invention connecting a liquid container 100A to a pump 20. The liquid container 100A is enclosed within the outer protective container 110A located within the prior art dispenser device 10 shown in FIGS. 1-4. The liquid container 100A includes a fitment 120A for connecting the liquid container 100A to the pump 20 through a pump mounting 140A and a coupling 160A of the present invention.

Figure 25:
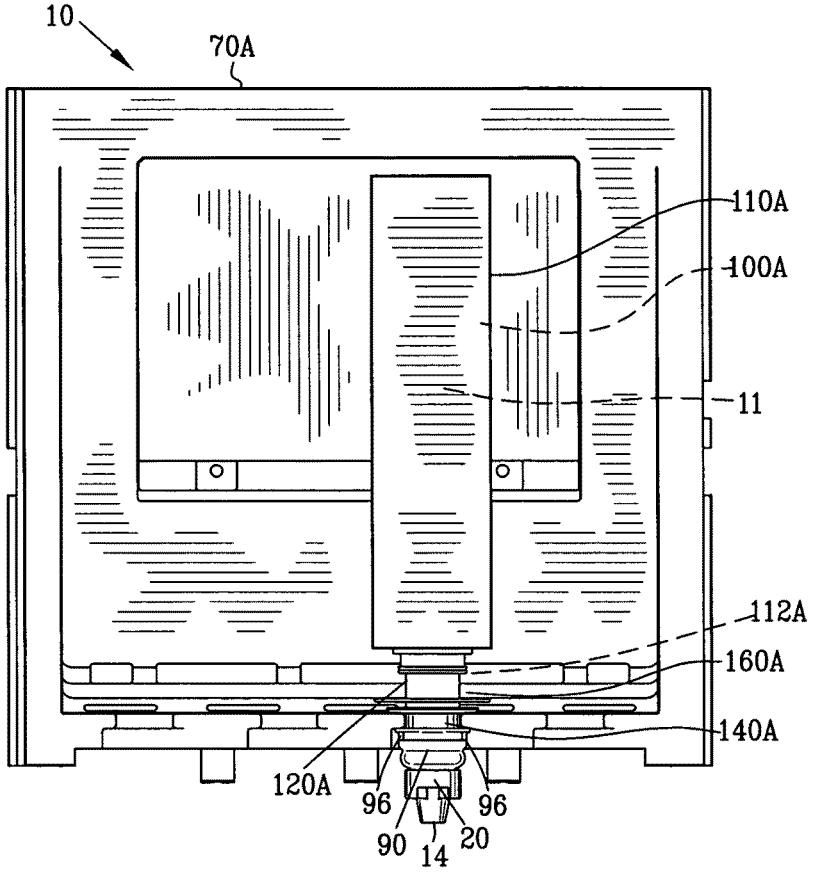
FIG. 25 is a view along line 25-25 in FIG. 24.

FIG. 25 is a view along line 25-25 in FIG. 24 illustrating the liquid container 100A within the outer protective container 110A inserted within the prior art dispenser device 10 shown in FIGS. 1-4. In this embodiment, the outer protective container 110A is similar in dimensions to the container 16 to enable the liquid container 100A within the outer protective container 110A to be inserted within the prior art dispenser device 10 shown in FIGS. 1-4. The pump mounting 140A and the coupling 160A of the present invention enables the liquid container 100A to be used with the pump and mixing device 20 of shown in U.S. Pat. No. 5,114,047. A more detailed explanation of the liquid container 100A and the outer protective container 110A and the fitment 120A will be forthcoming with reference to FIGS. 26-30.

Figure 26:
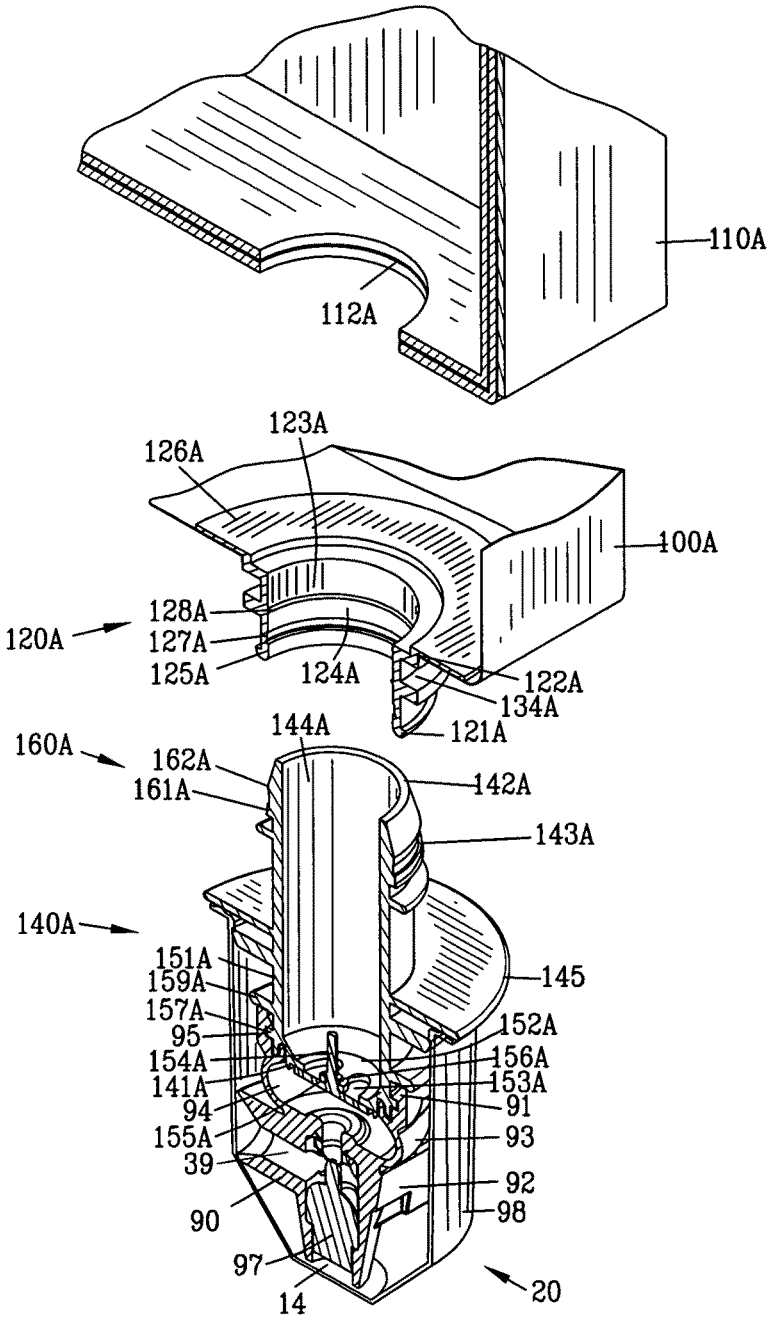
FIG. 26 is an enlarged exploded lower isometric view of the second embodiment of the coupling of the present invention connecting the liquid container to the pump.

FIG. 26 is an enlarged exploded lower isometric view of the second embodiment of the coupling 160A of the present invention connecting the liquid container 100A to the pump 20. In a manner similar to FIG. 5, the pumping and mixing device 20 comprises a body member 90 having an input body portion 91 and an output body portion 92 with a flexible wall 93 interconnecting the input body portion 91 and the output body portion 92 defining a pumping chamber 94. An annular indentation 95 is defined within the input body portion 91 for mounting the pump and mixing device 20 to a pump mounting 140A. Plural recesses 96 shown in FIG. 25 are defined in the output body portion 92 for receiving the plural coupling fingers 47 extending from the pivot arm 46 as shown in FIG. 4. An output one-way valve 97 is located within the pump and mixing device 20. An overcap 98 removably engages with the pump mounting 140A for covering the pumping and mixing device 20 to prevent contamination during shipment and storage.

A pump mounting 140A comprises a first mounting portion 141A and a second mounting portion 142A forming a cylindrical member 143A having a cylindrical aperture 144A. A support disk 145A is defined between the first mounting portion 141A and the second mounting portion 142A. A plurality of ribs 146A extend from the cylindrical member 143A to reinforce the support disk 145A.

The second mounting portion 142A includes a coupling 160 comprising stops 161A and 162A for securing the pump mounting 140A to the fitment 120A. Each of the stops 161A and 162A is a projection extending outwardly from the second mounting portion 142A. Preferably, each of the stops 161A and 162A is tapered to facilitate insertion and to inhibit removal of the second mounting portion 142A within the internal fitment bore 124A of the fitment 120A.

Figure 27:
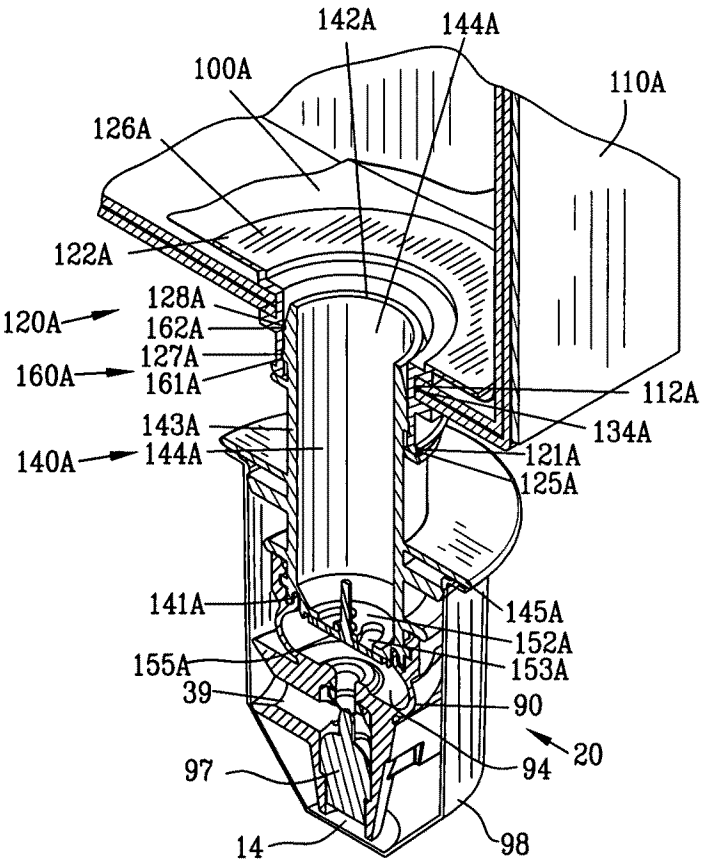
FIG. 27 is an assembled top isometric sectional view of FIG. 26.
Figure 29:
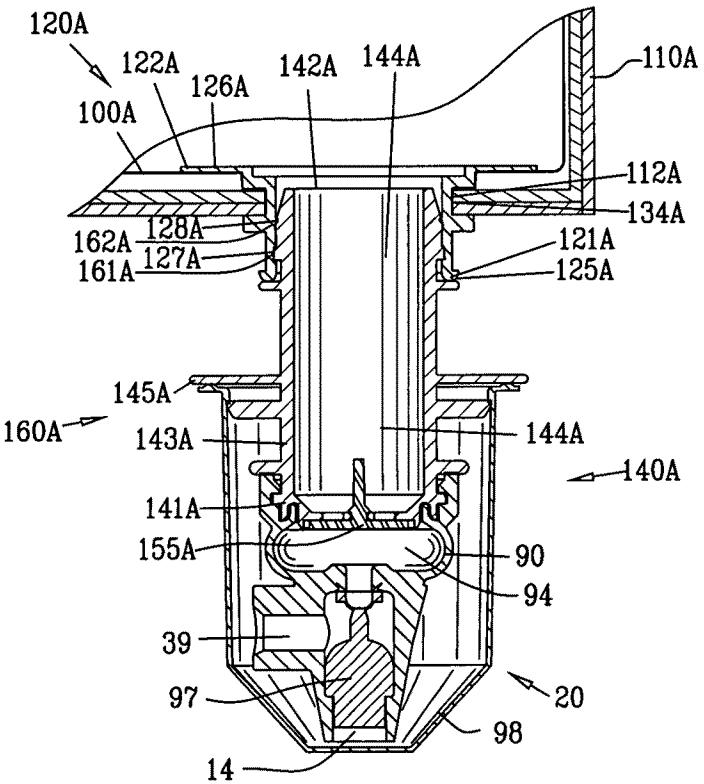
FIG. 29 is a side sectional view of FIG. 27.

FIGS. 27 and 29 are assembled views of FIG. 26 illustrating the second embodiment of the invention in a condition suitable for shipping. The second mounting portion 142A of the pump mounting 140A is slidably received within the internal fitment bore 124A of the fitment 120A. As best shown in FIG. 29, the stops 161A and 162A on the second mounting portion 142A of the pump mounting 140 are received within the bore depressions 127A and 128A of the internal fitment bore 124A of the fitment 120A. The stops 161A and 162A received within the bore depressions 127A and 128A inhibit removal of the second coupling portion 142A from the internal fitment bore 124A of the fitment 120A and prevent removal of the pump and mixing device 20 from the container 100.

Figure 28:
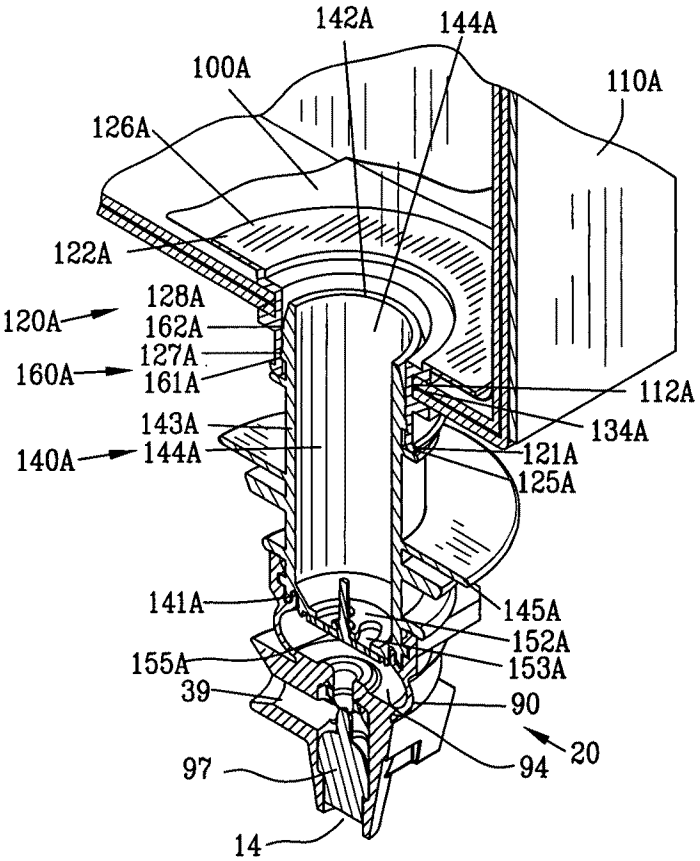
FIG. 28 is a view similar to FIG. 27 with a container cap removed.
Figure 30:
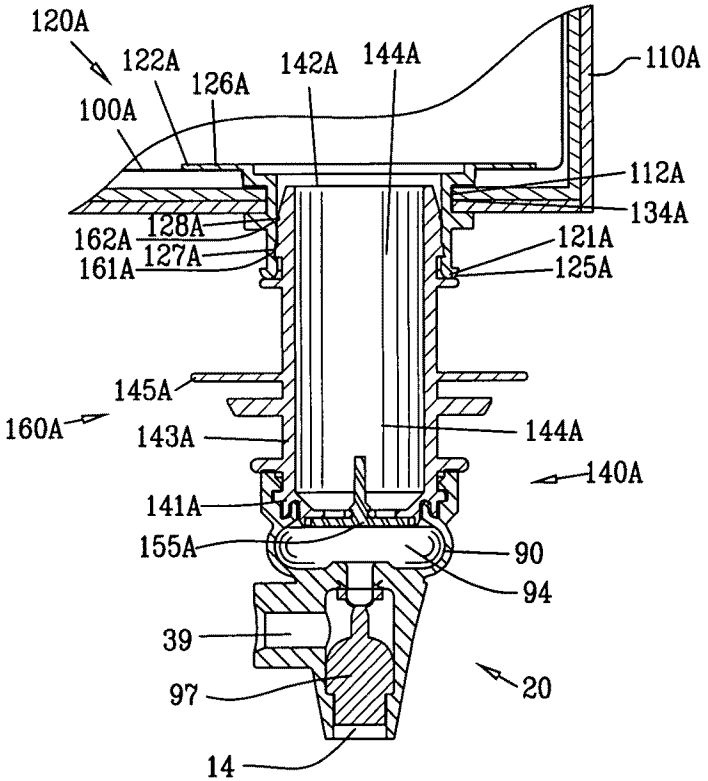
FIG. 30 is a side sectional view of FIG. 28.

FIGS. 28 and 30 are assembled views similar to FIGS. 27 and 29 illustrating the second embodiment of the invention in a condition suitable for use. The overcap 98 has been removed exposing the pumping and mixing device 20. The pumping and mixing device 20 and the container 100 is ready for insertion within the dispenser device 10 for dispensing the liquid 11.

The dispensing device of the present invention provides a system that substantially advances the liquid dispensing art. The present invention enables the use of flexible liquid aseptic container with the prior art dispenser device 10. In the alternative, the present invention enables the use of a refrigerated flexible liquid container (non-aseptic) or non-refrigerated flexible liquid container with or without preservatives with the prior art dispenser device 10.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved coupling for connecting a pump to a container, the container having a fitment defining an internal fitment bore communicating with the container with a frangible seal sealing said internal fitment bore, comprising:

a coupling having a first and a second coupling portion with an internal coupling bore extending therethrough;

a coupling engagement for securing said first coupling portion of said coupling to said pump for enabling the flow of liquid through said internal coupling bore to said pump;

a coupling sleeve defining a proximal sleeve end and a distal sleeve end with proximal sleeve end extending from said coupling;

said distal sleeve end of said coupling sleeve being slidably received within said internal fitment bore of said fitment;

a spacer interposed between said coupling and said fitment for spacing said distal sleeve end of said coupling from said frangible seal and for inhibiting said distal sleeve end of said coupling to slide within said internal fitment bore toward said frangible seal;

a first stop for inhibiting removal of said coupling from said fitment; and said spacer being removable for enabling said distal sleeve end of said coupling to slide within said internal fitment bore to pierce said frangible seal for providing liquid communication from the container to the pump.

2. An improved coupling as set forth in claim 1, wherein said coupling and said coupling sleeve are formed as a one-piece unit.

3. An improved coupling as set forth in claim 1, wherein said removable spacer is secured to said coupling.

4. An improved coupling as set forth in claim 1, wherein said removable spacer is secured to said coupling by a frangible connector.

5. An improved coupling as set forth in claim 1, wherein said removable spacer is a frangible collar interposed between said coupling and said fitment for inhibiting movement therebetween.

6. An improved coupling as set forth in claim 1, wherein the removable spacer is secured to said coupling by a frangible connection.

7. An improved coupling as set forth in claim 1, wherein said first stop is located on said coupling sleeve.

8. An improved coupling as set forth in claim 1, including a second stop for locating said coupling in a second position relative to said fitment whereat said distal sleeve end pierces said frangible seal and for inhibiting removal of said coupling from said fitment.

9. An improved coupling as set forth in claim 1, including a second stop for locating said coupling in a second position relative to said fitment whereat said distal sleeve end pierces said frangible seal and for inhibiting removal of said coupling from said fitment; and said second stop being located on said coupling sleeve.

10. An improved coupling for connecting a mixing pump to a liquid container for pumping a first liquid from the liquid container and for mixing the first liquid with a second liquid within the mixing pump, comprising a fitment extending between an inner fitment end and an outer fitment end with said inner fitment end affixed relative to the liquid container;

an internal fitment bore extending through said fitment for enabling the introduction and discharge of the first liquid there through;

an inner frangible seal located relative to said inner fitment end of said fitment for sealing said internal fitment bore;

a pump mounting secured to said mixing pump;

a coupling having a first and a second coupling portion with an internal coupling bore extending therethrough;

a coupling engagement for securing said first coupling portion of said coupling to said mixing pump mounting for enabling the flow of the first liquid through said internal coupling bore to said mixing pump;

a coupling sleeve defining a proximal sleeve end secured to said coupling with said distal sleeve end extending from said coupling;

said distal sleeve end of said coupling sleeve being slidably received within said internal fitment bore of said fitment;

a spacer interposed between said coupling and said fitment for spacing said distal sleeve end of said coupling from said inner frangible seal and for inhibiting said distal sleeve end of said coupling to slide within said internal fitment bore toward said frangible seal;

a first stop for inhibiting removal of said coupling from said fitment; and said spacer being removable for enabling said distal sleeve end of said coupling to slide within said internal fitment bore to pierce said inner frangible seal for providing liquid communication from the liquid container to the mixing pump.

11. An improved coupling as set forth in claim 10, wherein the liquid container is a flexible container.

12. An improved coupling as set forth in claim 10, wherein the liquid container is a flexible container located with a generally rigid outer protective container.

13. An improved coupling as set forth in claim 10, wherein said fitment comprises a generally rigid cylindrical portion.

14. An improved coupling as set forth in claim 10, including an inner fitment flange and an outer fitment flange secured to said inner fitment end and said outer fitment end of said fitment, respectively; and said inner frangible seal being affixed to said inner fitment flange of said fitment.

15. An improved coupling as set forth in claim 10, wherein said coupling and said coupling sleeve are formed as a one-piece unit.

16. An improved coupling as set forth in claim 10, wherein said spacer is a secured to said coupling.

17. An improved coupling as set forth in claim 10, wherein said spacer is secured to said coupling by a frangible connection.

18. An improved coupling as set forth in claim 10, wherein said spacer is a frangible collar interposed between said coupling and said fitment for inhibiting movement therebetween.

19. An improved coupling as set forth in claim 10, wherein said first stop is interposed between said coupling sleeve and said internal fitment bore of said fitment.

20. An improved coupling as set forth in claim 10, including a second stop for locating said coupling in a second position relative to said fitment whereat said distal sleeve end pierces said inner frangible seal and for inhibiting removal of said coupling from said fitment.

21. An improved coupling as set forth in claim 10, including a second stop for locating said coupling in a second position relative to said fitment whereat said distal sleeve end pierces said proximal frangible seal and for inhibiting removal of said coupling from said fitment; and said second stop being interposed between said coupling sleeve and said internal fitment bore of said fitment.

* * * * *